US006844866B2

(12) United States Patent
Watanabe

(10) Patent No.: US 6,844,866 B2
(45) Date of Patent: Jan. 18, 2005

(54) METHOD FOR DRIVING LIQUID CRYSTAL DISPLAY, DRIVING CIRCUIT FOR LIQUID CRYSTAL DISPLAY, AND IMAGE DISPLAY DEVICE USING SAME

(75) Inventor: Takashi Watanabe, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 526 days.

(21) Appl. No.: 09/906,087

(22) Filed: Jul. 17, 2001

(65) Prior Publication Data

US 2002/0005830 A1 Jan. 17, 2002

(30) Foreign Application Priority Data

Jul. 17, 2000 (JP) ..... 2000-216621

(51) Int. Cl.[7] ..... G09G 3/36

(52) U.S. Cl. ..... 345/88; 345/94; 345/208; 345/212

(58) Field of Search ..... 345/87, 88, 98–100, 345/94, 95, 204, 208, 92, 93, 211–213

(56) References Cited

U.S. PATENT DOCUMENTS 5,604,511 A * 2/1997 Ohi ..... 345/98
5,973,661 A * 10/1999 Kobayashi et al. ..... 345/100
6,219,023 B1 * 4/2001 Kim ..... 345/698

FOREIGN PATENT DOCUMENTS

JP 6-295162 10/1994
JP 9-134149 5/1997

* cited by examiner

*Primary Examiner*—Henry N. Tran
(74) *Attorney, Agent, or Firm*—Young & Thompson

(57) ABSTRACT

A method for driving a liquid crystal display, and a driving circuit of the liquid crystal display configured at low costs and being small in size, and an image display device are provided, which are capable of converting an analog and serial video signal having a high resolution into a parallel video signal, which enables high-quality images to be displayed with high resolutions without inconsistencies in displaying. In response to sampling pulses, analog and serial video signal is sequentially sample-held as ten pieces of parallel video signals and four-pieces of continuously sample-held video signals are output simultaneously as four parallel video signals while these signals are held and in response to the sampling pulse by being selected earlier by a delay time in switching of selectors than sampling in the next period is started.

28 Claims, 12 Drawing Sheets

*FIG.3*

| $S_{CTL}$ | | | $S_{RP1}$ | $S_{RP2}$ | $S_{RP3}$ | $S_{RP4}$ |
|---|---|---|---|---|---|---|
| $S_{CTL3}$ | $S_{CTL2}$ | $S_{CTL1}$ | | | | |
| L | L | L | $S_{R1}$ | $S_{R2}$ | $S_{R3}$ | $S_{R4}$ |
| L | L | H | $S_{R5}$ | $S_{R6}$ | $S_{R7}$ | $S_{R8}$ |
| L | H | L | $S_{R9}$ | $S_{R10}$ | $S_{R1}$ | $S_{R2}$ |
| L | H | H | $S_{R3}$ | $S_{R4}$ | $S_{R5}$ | $S_{R6}$ |
| H | L | L | $S_{R7}$ | $S_{R8}$ | $S_{R9}$ | $S_{R10}$ |

*FIG. 7*

| $S_{CTL}$ | | | | $S_{RP1}$ | $S_{RP2}$ | $S_{RP3}$ | $S_{RP4}$ |
|---|---|---|---|---|---|---|---|
| $S_{CTL4}$ | $S_{CTL3}$ | $S_{CTL2}$ | $S_{CTL1}$ | | | | |
| L | L | L | L | $S_{R1}$ | $S_{R2}$ | $S_{R3}$ | $S_{R4}$ |
| L | L | L | H | $S_{R5}$ | $S_{R6}$ | $S_{R7}$ | $S_{R8}$ |
| L | L | H | L | $S_{R9}$ | $S_{R1}$ | $S_{R2}$ | $S_{R3}$ |
| L | L | H | H | $S_{R4}$ | $S_{R5}$ | $S_{R6}$ | $S_{R7}$ |
| L | H | L | L | $S_{R8}$ | $S_{R9}$ | $S_{R1}$ | $S_{R2}$ |
| L | H | L | H | $S_{R3}$ | $S_{R4}$ | $S_{R5}$ | $S_{R6}$ |
| L | H | H | L | $S_{R7}$ | $S_{R8}$ | $S_{R9}$ | $S_{R1}$ |
| L | H | H | H | $S_{R2}$ | $S_{R3}$ | $S_{R4}$ | $S_{R5}$ |
| H | L | L | L | $S_{R6}$ | $S_{R7}$ | $S_{R8}$ | $S_{R9}$ |

METHOD FOR DRIVING LIQUID CRYSTAL DISPLAY, DRIVING CIRCUIT FOR LIQUID CRYSTAL DISPLAY, AND IMAGE DISPLAY DEVICE USING SAME

BACKGROUND OF THE INVENTION

1. Field of the Invention

The present invention relates to a method for driving a liquid crystal display, a driving circuit of the liquid crystal display, and an image display device and more particularly relates to the method for driving the liquid crystal display, and the driving circuit of the liquid crystal display in which liquid crystal cells are arranged in a matrix form, and the image display device being equipped with the liquid crystal display.

The present application claims priority of Japanese Patent Application No.2000-216621 filed on Jul. 17, 2000, which is hereby incorporated by reference.

2. Description of the Related Art

FIG. 10 is a schematic block diagram showing configurations of a driving circuit of a conventional color liquid crystal display 21 disclosed in Japanese Patent Application Laid-open No. Hei 6-295162. The color liquid crystal display 21 is an active-matrix type color liquid crystal display using a TFT (Thin Film Transistor) as a switching element in which each of pixels is placed at an intersection of a plurality of scanning electrodes (gate lines) 22 mounted at specified intervals in a row direction and a plurality of data electrodes (source lines) 23 mounted at specified intervals in a column direction and each of the pixels includes a liquid crystal cell 24 being an equivalent capacitive load, TFT 25, used to drive each of corresponding liquid crystal cells 24 and a capacitor (not shown) used to accumulate a data electric charge during one vertical synchronized period and in which a data red signal, data green signal, and data blue signal generated based on a serial video red signal $S_R$, a serial video green signal $S_G$, and a serial video blue signal $S_B$ are applied to the data electrodes 23 and scanning signals generated based on a horizontal synchronizing signal $S_H$ and a vertical synchronizing signal $S_V$ are applied to the scanning electrodes 22, thus allowing a color character, image, or a like to be displayed.

Moreover, the driving circuit of the conventional color liquid crystal display chiefly includes a controller 31, a serial/parallel converting circuit 32, a gamma converting circuit 33, a data inverting circuit 34, data electrode driving circuits $\mathbf{35}_1$ and $\mathbf{35}_2$ and a scanning electrode driving circuit 36. The controller 31 generates an upper side horizontal scanning pulse $P_{HU}$, a lower side horizontal scanning pulse $P_{HD}$, and a vertical scanning pulse $P_V$ based on the horizontal synchronizing signal $S_H$ fed from outside and vertical synchronizing signal $S_V$ and feeds them to the data electrode driving circuits $\mathbf{35}_1$ and $\mathbf{35}_2$ and the scanning electrode driving circuit 36 and, at the same time, controls each of the components. The serial/parallel converting circuit 32 has each of serial/parallel converting sections 32*a*, 32*b* and 32*c* (not shown), which corresponds to the serial video red signal $S_R$, the serial video green signal $S_G$, and the serial video blue signal $S_B$ all of which are analog signals fed from outside and each of the serial/parallel converting sections 32*a*, 32*b* and 32*c* is adapted to convert the serial video red signal $S_R$, the serial video green signal $S_G$ and the serial video blue signal $S_B$, under control of the controller 31, into parallel video red signal $S_{RP}$, parallel video green signal $S_{GP}$, and parallel video blue signal $S_{BP}$. The gamma converting circuit 33 makes a gamma correction to the parallel video red signal $S_{RP}$, the parallel video green signal $S_{GP}$, and the parallel video blue signal $S_{BP}$ to provide shades of gray and outputs as a parallel video red signal $S_{RG}$, a parallel video green signal $S_{GG}$, and a parallel video blue signal $S_{BG}$, respectively.

The data inverting circuit 34, in order to drive the color liquid crystal display 21 with alternating current, reverses polarity of a half of each of the parallel video red signal $S_{RG}$, the parallel video green signal $S_{GG}$, and the parallel blue signal $S_{BG}$ relative to standard voltages of the data electrode driving circuits $\mathbf{35}_1$ and $\mathbf{35}_2$ so that the parallel video red signal $S_{RG}$, the parallel video green signal $S_{GG}$, and the parallel video blue signal $S_{BG}$ become a negative phase video red signal $NS_{RG}$, a negative phase video green signal $NS_{GG}$, and a negative phase video blue signal $NS_{BG}$ respectively and, at the same time, feeds them together with a remaining half of the parallel video red signal $S_{RG}$, the parallel video green signal $S_{GG}$, and the parallel video blue signal $S_{BG}$ to the data electrode driving circuits $\mathbf{35}_1$ and $\mathbf{35}_2$ by switching between these signals every time one line is written. The data electrode driving circuits $\mathbf{35}_1$ and $\mathbf{35}_2$, with timing of the upper side horizontal scanning pulse $P_{HU}$ and the lower side horizontal scanning pulse $P_{HD}$ being fed from the controller 31, generates a data red signal from either of the parallel video red signal $S_{RG}$ or the negative phase video red signal $NS_{RG}$, a data green signal from either of the parallel video green signal $S_{GG}$ or the negative phase video green signal $NS_{GG}$, and a data blue signal from either of the parallel video blue signal $S_{BG}$ or the negative phase video blue signal $NS_{BG}$ and feeds them to each of corresponding data electrodes 23 of the color liquid crystal display 21. The scanning electrode driving circuit 36, with timing of the vertical scanning pulse Pv fed from the controller 31, generates a scanning signal and applies it to each of the corresponding scanning electrodes 22 of the color liquid crystal display 21.

FIG. 11 is a circuit diagram showing configurations of a serial/parallel converting section 32*a* making up the serial/parallel converting circuit 32 in the conventional color liquid crystal display 21. The serial/parallel converting section 32*a* shown in FIG. 11 is made up of a shift register 41, 2n-pieces (n is an integer being 2 or more) of sample holding circuits $\mathbf{42}_1$ to $\mathbf{42}_{2n}$ and n-pieces of selectors $\mathbf{43}_1$ to $\mathbf{43}_n$ and converts the serial video red signal $S_R$ into n-pieces of parallel video red signals $S_{RP1}$ to $S_{RPn}$. The shift register 41 is a serial-in/parallel-out type shift register made up of 2n-pieces of delay flip-flops (DFF) and performs a shifting operation to shift a start pulse STP fed from the controller 31, in synchronization with a shift clock SCK fed from the controller 31, and simultaneously outputs each bit of 2n bits of parallel data as sampling pulses $SP_1$ to $SP_{2n}$ to each of the sample holding circuits $\mathbf{42}_1$ to $\mathbf{42}_{2n}$. Each of the sample holding circuits $\mathbf{42}_1$ to $\mathbf{42}_{2n}$, based on each of the corresponding sampling pulses $SP_1$ to $SP_{2n}$ each being fed from the shift register 41, samples each of voltages $S_{R1}$ to $S_{R2n}$ of the serial video red signal $S_R$ and holds each of the sampled voltages $S_{R1}$ to $S_{R2n}$ of the serial video red signal $S_R$ for specified period of time. Moreover, though each value of the voltages $S_{R1}$ to $S_{R2n}$ in a present period is actually different from each value of the voltages $S_{R1}$ to $S_{R2n}$ in a next period, since it is output from the same sample holding circuit 42, a same symbol is assigned to these values. Each of the selectors $\mathbf{43}_1$ to $\mathbf{43}_n$, based on a selector control signal $S_{CTL}$ fed from the controller 31, outputs either of the voltages $S_{R1}$ to $S_{Rn}$ Of the serial video red signal $S_R$ fed from the corresponding sample holding circuits $\mathbf{42}_1$ to $\mathbf{42}_n$ or voltages $S_{R(n+1)}$ to $S_{R2n}$ of the serial video red signal $S_R$ fed from the corresponding sample holding circuits $42_{n+1}$ to $42_{2n}$ as each of the parallel video red signals $S_{RP1}$ to $S_{RPn}$.

Moreover, configurations of the serial/parallel converting sections 32*b* and 32*c* (not shown) are the same as those of the serial/parallel converting section 32*a* except that the signals input and output are different, therefore description of the serial/parallel converting section 32*b* and 32*c* are omitted.

Next, operations of the serial/parallel converting section 32*a* will be described by using a case as an example in which n=4, that is, eight pieces of the sample holding circuits $42_1$ to $42_8$ and four pieces of the selectors $43_1$ to $43_4$ are mounted in the serial/parallel converting section 32*a*, by referring to the timing chart shown in FIG. 12. First, the shift register 41, when the start pulse STP (not shown) and shift clock SCK (shown in FIG. 12(1)) are fed from the controller 31, performs shifting operations to shift the start pulse STP in synchronization with the shift clock SCK and outputs each bit of 2n-bit parallel data as sampling pulses $SP_1$ to $SP_8$ (shown in FIG. 12(3) to FIG. 12(10)).

Therefore, when the analog and serial video red signal $S_R$ (shown in FIG. 12(2)) is fed from outside, the sample holding circuit $42_1$, while the sampling pulse $SP_1$ is high, samples a voltage $S_{R1}$ of the serial video red signal $S_R$ and, then, while the sampling pulse $SP_1$ is low, holds the voltage $S_{R1}$ of the sampled video red signal $S_R$. Though the serial video red signal $S_R$ is an analog signal, in FIG. 12(2), to simplify description, each of the voltages $S_{R1}$ to $S_{R8}$ is expressed as if they were digital data.

Similarly, the sample holding circuit $42_2$, while the sampling pulse $SP_2$ shown in FIG. 12(4) is high, samples a voltage $S_{R2}$ of the serial video red signal $S_R$ and then, while the sampling pulse $SP_2$ is low, holds the voltage $S_{R2}$ of the sampled video red signal $S_R$. The sample holding circuit $42_3$, while the sampling pulse $SP_3$ shown in FIG. 12(5) is high, samples a voltage $S_{R3}$ of the serial video red signal $S_R$ and then, while the sampling pulse $SP_3$ is low, holds the voltage $S_{R3}$ of the sampled video red signal $S_R$. The sample holding circuit $42_4$, while the sampling pulse $SP_4$ shown in FIG. 12(6) is high, samples a voltage $S_{R4}$ of the serial video red signal $S_R$ and then, while the sampling pulse $SP_4$ is low, holds the voltage $S_{R4}$ of the sampled video red signal $S_R$.

Next, when the selector control signal $S_{CTL}$ is changed to be high in synchronization with a fifth rise of the shift clock SCK as shown in FIG. 12(11), the selectors $43_1$ to $43_4$, based on the selector control signal $S_{CTL}$ at a high level, by connecting each of common terminals $T_c$ to a first terminal $T_1$, during periods being surrounded by broken lines shown in the left part of FIGS. 12(3) to (6) and outputs the voltages $S_{R1}$ to $S_{R4}$ of the serial video red signal $S_R$ held by each of the corresponding sample holding circuits $42_1$ to $42_4$ as the parallel video red signals $S_{RP1}$ to $S_{RP4}$.

Next, the sample holding circuit $42_5$, while the sampling pulse $SP_5$ is high shown in FIG. 12(7), samples a voltage $S_{R5}$ of the serial video red signal $S_R$ and then holds, while the sampling pulse $SP_5$ is low, the voltage $S_{R5}$ of the sampled video red signal $S_R$. Similarly, the sample holding circuit $42_6$, while the sampling pulse $SP_6$ is high shown in FIG. 12(8), samples a voltage $S_{R6}$ of the serial video red signal $S_R$ and then holds, while the sampling pulse $SP_6$ is low, the voltage $S_{R6}$ of the sampled video red signal $S_R$. The sample holding circuit $42_7$, while the sampling pulse $SP_7$ is high shown in FIG. 12(9), samples a voltage $S_{R7}$ of the serial video red signal $S_R$ and then holds, while the sampling pulse $SP_7$ is low, the voltage $S_{R7}$ of the sampled video red signal $S_R$. The sample holding circuit $42_8$, while the sampling pulse $SP_8$ is high shown in FIG. 12(10), samples a voltage $S_{R8}$ of the serial video red signal $S_R$ and then holds, while the sampling pulse $SP_8$ is low, the voltage $S_{R8}$ of the sampled video red signal $S_R$.

Next, when the selector control signal $S_{CTL}$ is changed to be low in synchronization with a ninth rise of the shift clock SCK as shown in FIG. 12(11), the selectors $43_1$ to $43_4$, based on the selector control signal $S_{CTL}$ at a low level, by connecting each of the common terminals $T_c$ to a second terminal $T_2$, during periods being surrounded by the broken lines shown in the left part of FIGS. 12(7) to (10), outputs the voltages $S_{R5}$ to $S_{R8}$ of the serial video red signal $S_R$ held by each of the corresponding sample holding circuits $42_5$ to $42_8$ as the parallel video red signals $S_{RP1}$ to $S_{RP4}$.

Operations described above are sequentially repeated at four-clock intervals of the shift clock SCK. Operations for the serial video green signal $S_G$ and serial video blue signal $S_B$ are the same as those for the above serial video red signal $S_R$.

The reason why such the serial/parallel converting circuit 32 is mounted in a driving circuit of the conventional liquid crystal display described above is as follows. That is, in ordinary cases, operation speeds of the data electrode driving circuits $35_1$ and $35_2$ are lower than that of the controller 31, the gamma converting circuit 33 and the data inverting circuit 34. For example, in a case of a liquid crystal display called an SXGA (Super Extended Graphics Array)-type liquid crystal display which has a resolution of 1280×1024 pixels, though frequency of an operating clock of the controller 31 or a like, that is, the frequency of an analog and serial video signal fed from outside is 135 MHz, the frequency of the operating clock of the data electrode driving circuits $35_1$ and $35_2$ is about 20 MHz. To solve this problem, by converting the serial video signal having high frequencies, that is, with high resolution, into the parallel video signal so that simultaneous and parallel processing can be performed even in low-speed data electrode driving circuits $35_1$ and $35_2$, operation speeds of the data electrode driving circuits $35_1$ to $35_2$ to a frequency characteristic of a video signal with high resolution fed from outside are matched. Such the signal processing in which the serial video signal is converted into the parallel video signal is called "phase expansion" in a sense that one signal with high frequencies is expanded so as to become a plurality of signals of phases with low frequencies. For example, in the case of the SXGA-type liquid crystal display, by expanding the serial video signal fed from outside so as to become the signal of eight phases, the frequency is changed to be 16.875 MHz (135 MHz/8 phases), which enables the data electrode driving circuits $35_1$ and $35_2$ with their operation speeds of about 20 MHz to successfully perform signal processing.

In a recent advanced state of multimedia, high definition is required in a liquid crystal display including compatibility with a photo or a printed matter of extremely high resolutions and a liquid crystal display called a UXGA (Ultra Extended Graphics Array)-type liquid crystal display which has a resolution of 1600×1200 pixels has been developed. In the UXGA-type liquid crystal display, the frequency of the serial video signal fed from outside is 162 MHz. Therefore, even if this serial video signal is phase-expanded so as to become a signal of eight phases, the frequency becomes 20.25 MHz (162 MHz/8 phases), thus almost reaching an operational limit of the data electrode driving circuits $35_1$ to $35_2$. Therefore, if timing of rising and falling of the sampling pulses $SP_1$ to $SP_8$ is the same as that of rising and falling of the selector control signal $S_{CTL}$, the following inconvenience occurs. That is, if, for example, as shown by "a" in FIG. 12(6), the selector $\mathbf{43}_4$ is switched just during the settling time while the sample holding circuit $\mathbf{42}_4$ is sampling the voltage $S_{R4}$ of the serial video red signal $S_R$ based on the sampling pulse $SP_4$ at a high level, due to much settling time being time required for a voltage of a capacitor to reach within tolerance on an input voltage caused by a capacitance of the capacitor making up each of the sample holding circuit $\mathbf{42}_1$ to $\mathbf{42}_8$ and/or due to the timing in which the selector control signal $S_{CTL}$ rises earlier than the sampling pulse SP falls which is caused by a delay in signal transmission induced by routing of wirings, noise that should not be displayed appears on the color liquid crystal display 21, which causes inconsistencies in displaying. More particularly, if the selector $\mathbf{43}_4$ is switched earlier, though the voltage $S_{R4}$ of the serial video red signal $S_R$ is at a white level, than the capacitor making up the sample holding circuit $\mathbf{42}_4$ is charged sufficiently by the voltage $S_{R4}$ being at the white level, a part of the pixels is displayed in slightly darkish red on the liquid crystal display 21 (when the serial video green signal $S_G$ and the serial video blue signal $S_B$ are at a black level). The operations shown by "a" in FIG. 12(10) are the same as described above.

In contrast to the above, for example, as shown by "b" in FIG. 12(1), though the sample holding circuit $\mathbf{42}_1$ has already started sampling the voltage $S_{R1}$ due to delayed switching speed of the selector 43 and/or due to the timing in which the selector control signal $S_{CTL}$ falls later than the sampling pulse SP rises which is caused by a delay in signal transmission induced by routing of wirings, if the selector $\mathbf{43}_1$ has not yet been switched, noise that should not be displayed on the liquid crystal display 21 as inconsistencies in displaying on the liquid crystal display 21. More particularly, when the voltage $S_{R1}$ of the serial video red signal $S_R$ sampled during the present period is at a black level and the voltage $S_{R1}$ of the serial video red signal $S_R$ to be sampled during a next period is at a white level, though the sample holding circuit $\mathbf{42}_1$ has started sampling the voltage $S_{R1}$ of the serial video red signal $S_R$ at a white level, if the selector $\mathbf{43}_1$ has not yet been switched, part of the pixels is displayed in slightly bright red on the color liquid crystal display 21 (when the serial video green signal $S_G$ and the serial video blue signal $S_B$ are at a black level). The operations shown by "b" in FIG. 12(7) are the same as described above.

Conventionally, such the inconsistencies in displaying are resolved by finely calibrating the timing of rising or falling of the selector control signal $S_{CTL}$ and some inconsistencies in displaying are tolerated. However, in the UXGA-type liquid crystal display, since the data electrode driving circuits $\mathbf{35}_1$ and $\mathbf{35}_2$ are operated in a state almost reaching its operational limit, it is difficult to resolve such the inconsistencies in displaying and the inconsistencies exceed its tolerated limit. To solve this problem, a measure of increasing the number of the phases to be applied to the phase expansion may be proposed, however, it presents problems in that the number of the selector required for one color of the video signal is increased by the number of the increased phases and the number of the sample holding circuits is also increased by twofold numbers of the increased number of the phases, thus causing increased costs of the driving circuits of the liquid crystal display. Moreover, routing of wiring required for providing signals of so many phases to the driving circuit is made complicated and driving circuits of the liquid crystal display become large in size accordingly. Additionally, since an influence by delay in signals caused by the routing of the wiring cannot be neglected, it is impossible to solve the problem only by finely calibrating rising and falling of the selector control signal $S_{CTL}$.

On the other hand, in ordinary cases, since the data electrode driving circuits $\mathbf{35}_1$ and $\mathbf{35}_2$ and the scanning electrode driving circuit 36 are constructed of integrated circuits (IC) and, in recent years, the ICs are manufactured by using polysilicon which has high on-resistance and low operation speed in many cases, they cannot satisfactorily handle the serial video signal having high frequencies in the liquid crystal display with high definition. Moreover, in order to achieve miniaturization of the liquid crystal display, technology is being developed in which the data electrode driving circuits $\mathbf{35}_1$ and $\mathbf{35}_2$ and the scanning electrode driving circuit 36 are fabricated using polysilicon on a glass substrate on which the liquid crystal display is formed. In this case, the on-resistance of the switching device making up each of the driving circuits is made larger than that in the ordinary ICs and the operation speed is made lower, needs for a method and circuits to satisfactorily handle the video signal with high frequencies in the liquid crystal display with high definition.

SUMMARY OF THE INVENTION

In view of the above, it is an object of the present invention to provide a method for driving a liquid crystal display, a driving circuit of the liquid crystal display configured at low costs and being small in size and an image display device, which are capable of converting an analog and serial video signal having a high resolution into a parallel video signal, which enables high-quality images to be displayed with high resolutions without inconsistencies in displaying.

According to a first aspect of the present invention, there is provided a method for driving a liquid crystal display to drive the liquid crystal display based on n-pieces ("n" is an integer being two or more) of parallel video signals obtained by phase-expanding analog and serial video signals, the method including:

a first step of sequentially sample-holding the analog and serial video signals as (n+1) or more pieces of or (2n+1) or more pieces of parallel video signals in response to (n+1) or more pieces of or (2n+1) or more pieces of sampling pulses; and a second step of outputting n-pieces of continuously sample-held video signals sequentially or simultaneously as the n-pieces of parallel video signals while the sample-held video signals are individually or commonly held and in response to the sampling pulses each corresponding to each of the sample-held video signals or in response to the sampling pulse corresponding to the video signal sample-held first out of the sample-held video signals by selecting earlier at least by a time required for selecting and outputting said sample-held video signals individually or simultaneously than sampling is started in a next period.

According to a second aspect of the present invention, there is provided a method for driving a liquid crystal display to drive the liquid crystal display based on n-pieces ("n" is an integer being two or more) of parallel video signals obtained by phase-expanding analog and serial video signals, the method including:

a first step of sequentially sample-holding the analog and serial video signals as (n+1) or more pieces of parallel video signals in response to (n+1) or more pieces of sampling pulses; and a second step of sequentially outputting n-pieces of continuously sample-held video signals as the n-pieces of parallel video signals while the sample-held video signals are individually held and in response to the sampling pulses each corresponding to each of the sample-held video signals by selecting earlier at least by a first time required for individually selecting and outputting the sample-held video signals than sampling is started in a next period.

According to a third aspect of the present invention, there is provided a method for driving a liquid crystal display to drive the liquid crystal display based on n-pieces ("n" is an integer being two or more) of parallel video signals obtained by phase-expanding analog and serial video signals, the method including:

a first step of sequentially sample-holding the analog and serial video signals as (2n+1) or more pieces of parallel video signals in response to (2n+1) or more pieces of sampling pulses; and a second step of simultaneously outputting n-pieces of continuously sample-held video signals as the n-pieces of parallel video signals while the sample-held video signals are commonly held and in response to the sampling pulse corresponding to the video signal sample-held first out of the sample-held video signals by selecting earlier at least by a first time required for simultaneously selecting and outputting the sample-held video signals than sampling is started in a next period.

In the foregoing, a preferable mode is one wherein, in the second step, individual or simultaneous selection of the n-pieces of the continuously sample-held video signals is started after a lapse of a second time being almost equal to a settling time for each sample-held video signal or after a lapse of a second time being almost equal to a settling time of the video signal sample-held last out of the n-pieces of continuously sample-held video signals.

Also, a preferable mode is one wherein the first time represents one clock of the shift clocks used when the sampling pulse is generated and the second time represents one half clock of each of the shift clocks.

Also, a preferable mode is one wherein the analog and serial video signals include video red signals, video green signals, and video blue signals and wherein the first and second steps are performed for each of the video red signals, video green signals, and video blue signals.

Also, a preferable mode is one wherein the liquid crystal display is an active-matrix type liquid crystal display, a switching device of which is anyone of a TFT (Thin Film Transistor), MOSFET (Metal Oxide Semiconductor Field Effect Transistor), MIM (Metal Insulator Metal), varistor, and ringing diode.

Also, a preferable mode is one wherein the liquid crystal display is a direct-viewing type liquid crystal display or a projection-type liquid crystal display.

According to a fourth aspect of the present invention, there is provided a driving circuit for a liquid crystal display for driving the liquid crystal display based on n-pieces ("n" is an integer being two or more) of parallel video signals obtained by phase-expanding analog and serial video signals, including:

(n+1) or more of or (2n+1) or more of sample holding circuits to sequentially sample-hold the analog and serial video signals as (n+1) or more pieces of or (2n+1) or more pieces of parallel video signals in response to (n+1) or more pieces of or (2n+1) or more pieces of sampling pulses; and n-pieces of selectors to output n-pieces of continuously sample-held video signals sequentially or simultaneously as the n-pieces of parallel video signals while the sample-held video signals are individually or commonly held and in response to the sampling pulses each corresponding to each of the sample-held video signals or in response to the sampling pulse corresponding to the video signal sample-held first out of the sample-held video signals by selecting earlier at least by a time required for selecting and outputting these sample-held video signals individually or simultaneously than sampling is started in a next period.

According to a fifth aspect of the present invention, there is provided a driving circuit for a liquid crystal display for driving the liquid crystal display based on n-pieces ("n" is an integer being two or more) of parallel video signals obtained by phase-expanding analog and serial video signals, including:

(n+1) or more pieces of sample holding circuits to sequentially sample-hold the analog and serial video signals as (n+1) or more pieces of parallel video signals in response to (n+1) or more pieces of sampling pulses; and n-pieces of selectors to sequentially output n-pieces of continuously sample-held video signals as the n-pieces of parallel video signals while the sample-held video signals are individually held and in response to the sampling pulses each corresponding to each of the sample-held video signals by selecting earlier at least by a first time required for individually selecting and outputting the sample-held video signals than sampling is started in a next period.

According to a sixth aspect of the present invention, there is provided a driving circuit for a liquid crystal display for driving the liquid crystal display based on n-pieces ("n" is an integer being two or more) of parallel video signals obtained by phase-expanding analog and serial video signals, including:

(2n+1) or more pieces of sample holding circuits to sequentially sample-hold the analog and serial video signals as (2n+1) or more pieces of parallel video signals in response to (2n+1) or more pieces of sampling pulses; and n-pieces of selectors to simultaneously output n-pieces of continuously sample-held video signals as the n-pieces of parallel video signals while the sample-held video signals are commonly held and in response to the sampling pulse corresponding to the video signal sample-held first out of the sample-held video signals by selecting earlier at least by a first time required for simultaneously selecting and outputting the sample-held video signals then sampling is started in a next period.

In the foregoing, a preferable mode is one wherein the n-pieces of selectors start individual or simultaneous selection of the n-pieces of the continuously sample-held video signals after a lapse of a second time being almost equal to a settling time for each sample-held video signal or after a lapse of a second time being almost equal to a settling time of the video signal sample-held last out of the n-pieces of continuously sample-held video signals.

Also, a preferable mode is one wherein the first time represents one clock of the shift clocks used when the sampling pulse is generated and the second time represents one half clock of the shift clocks.

Also, a preferable mode is one wherein the analog and serial video signals include video red signals, video green signals, and video blue signals and wherein the (n+1) or more pieces of or (2n+1) or more pieces of sample holding circuits and the n-pieces of selectors are mounted for each of the video red signals, video green signals, and video blue signals.

Also, a preferable mode is one wherein the liquid crystal display is an active-matrix type liquid crystal display, a switching device of which is anyone of a TFT, MOSFET, MIM, varistor, and ringing diode.

Also, a preferable mode is one wherein the liquid crystal display is a direct-viewing type liquid crystal display or a projection-type liquid crystal display.

According to a seventh aspect of the present invention, there is provided an image display device including a direct-viewing type liquid crystal display and a driving circuit for a liquid crystal display stated above.

According to an eighth aspect of the present invention, there is provided an image display device including a projection-type liquid crystal display and a driving circuit for a liquid crystal display stated above.

In the foregoing, a preferable mode is one wherein the liquid crystal display is an active-matrix type liquid crystal display, a switching device of which is any one of a TFT, MOS FET, MIM, varistor, and ringing diode.

With the above configurations, in response to the (n+1) and more pieces of or (2n+1) and more pieces of sampling pulses, the analog and serial video signals are sequentially held as the (n+1) and more pieces of or (2n+1) and more pieces of parallel video signals and n-pieces of continuously sample-held video signals are output sequentially or simultaneously as n-pieces of parallel video signals during the holding period while these parallel video signals are individually or commonly held and in response to sampling pulses each corresponding to each of the video signals to be held or in response to the sampling pulse corresponding to the video signal sample-held for a first time out of the video signals by being selected earlier at least by the time required for individually or commonly selecting and outputting video signals than the sampling is started in the next period and, therefore, the driving circuit can be configured at low costs and being small in size and is capable of converting the analog and serial video signal having a high resolution into the parallel video signal, thus enabling high-quality images to be displayed with high resolutions without inconsistencies in displaying.

With another configuration, in response to the (n+1) pieces or more sampling pulses, the analog and serial video signals are sequentially sample-held as the parallel video signals and n-pieces of continuously sample-held video signals are sequentially output as n-pieces of parallel video signals while these sample-held video signals are individually held and in response to the sampling pulses each corresponding to each of the video signals by being selected earlier at least by the time required for individually selecting and outputting these sample-held video signals than the sampling is started in the next period and therefore the driving circuit can be configured at low costs and being small in size.

BRIEF DESCRIPTION OF THE DRAWINGS

The above and other objects, advantages, and features of the present invention will be more apparent from the following description taken in conjunction with the accompanying drawings in which:

FIG. 3 is a diagram showing one example of relations between a value of each of $S_{CTL1}$ to $S_{CTL3}$ of a selector control signal $S_{CTL}$ fed to each of selectors $\mathbf{4}_1$ to $\mathbf{4}_4$ and a voltage value output from the selectors $\mathbf{4}_1$ to $\mathbf{4}_4$ as parallel video red signals $S_{RP1}$ to $S_{RP4}$ according to the first embodiment of the present invention;

FIG. 7 is a diagram showing one example of relations between a value of each of $S_{CTL1}$ to $S_{CTL4}$ of a selector control signal $S_{CTL}$ fed to each of selectors $\mathbf{14}_1$ to $\mathbf{14}_4$ and a voltage value output from the selectors $\mathbf{14}_1$ to $\mathbf{14}_4$ as parallel video red signals $S_{RP1}$ to $S_{RP4}$ according to the second embodiment of the present invention;

DETAILED DESCRIPTION OF THE PREFERRED EMBODIMENTS

Best modes of carrying out the present invention will be described in further detail using various embodiments with reference to the accompanying drawings.

First Embodiment

Figure 1:
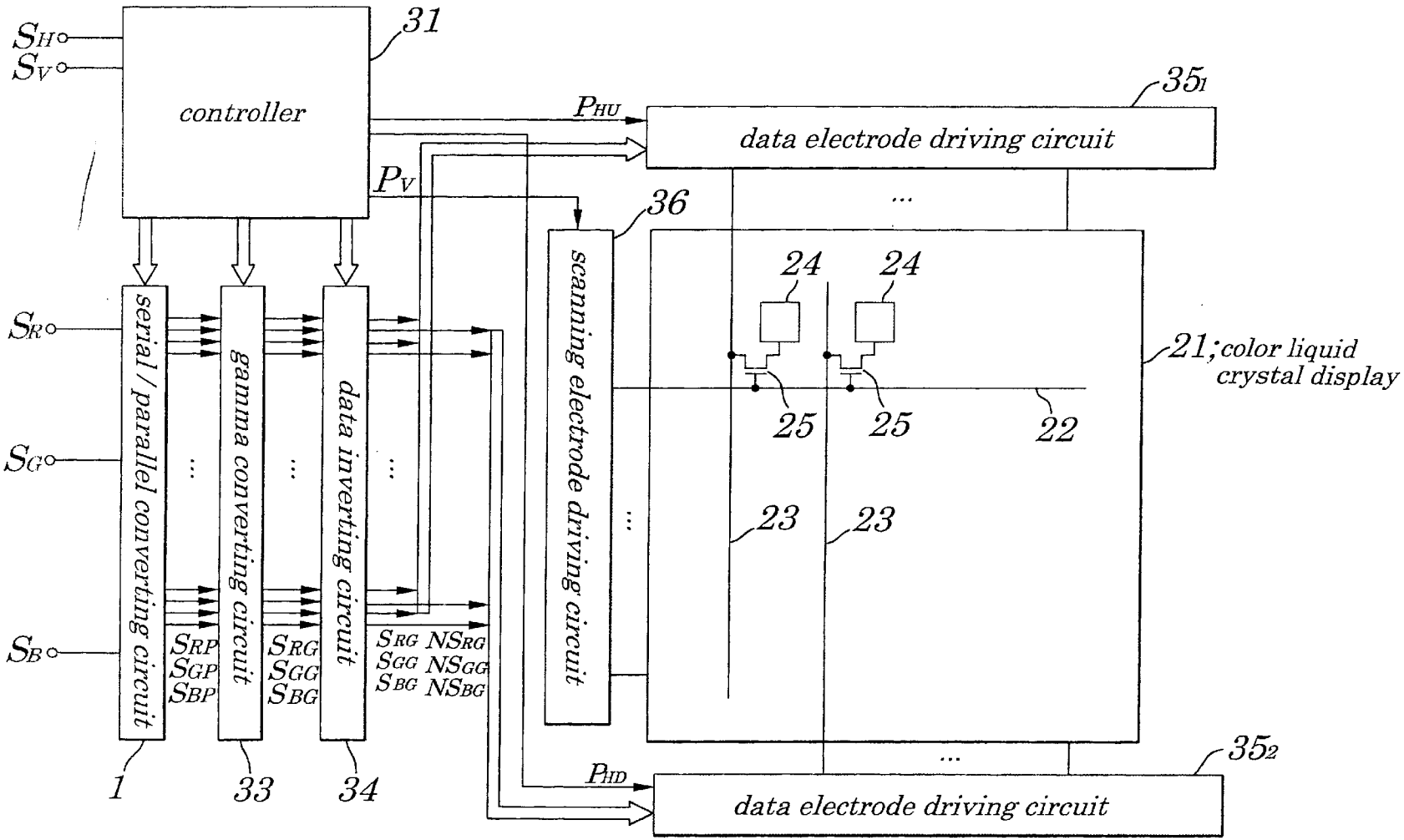
FIG. 1 is a schematic block diagram showing configurations of a driving circuit of a liquid crystal display according to a first embodiment of the present invention.
Figure 10:
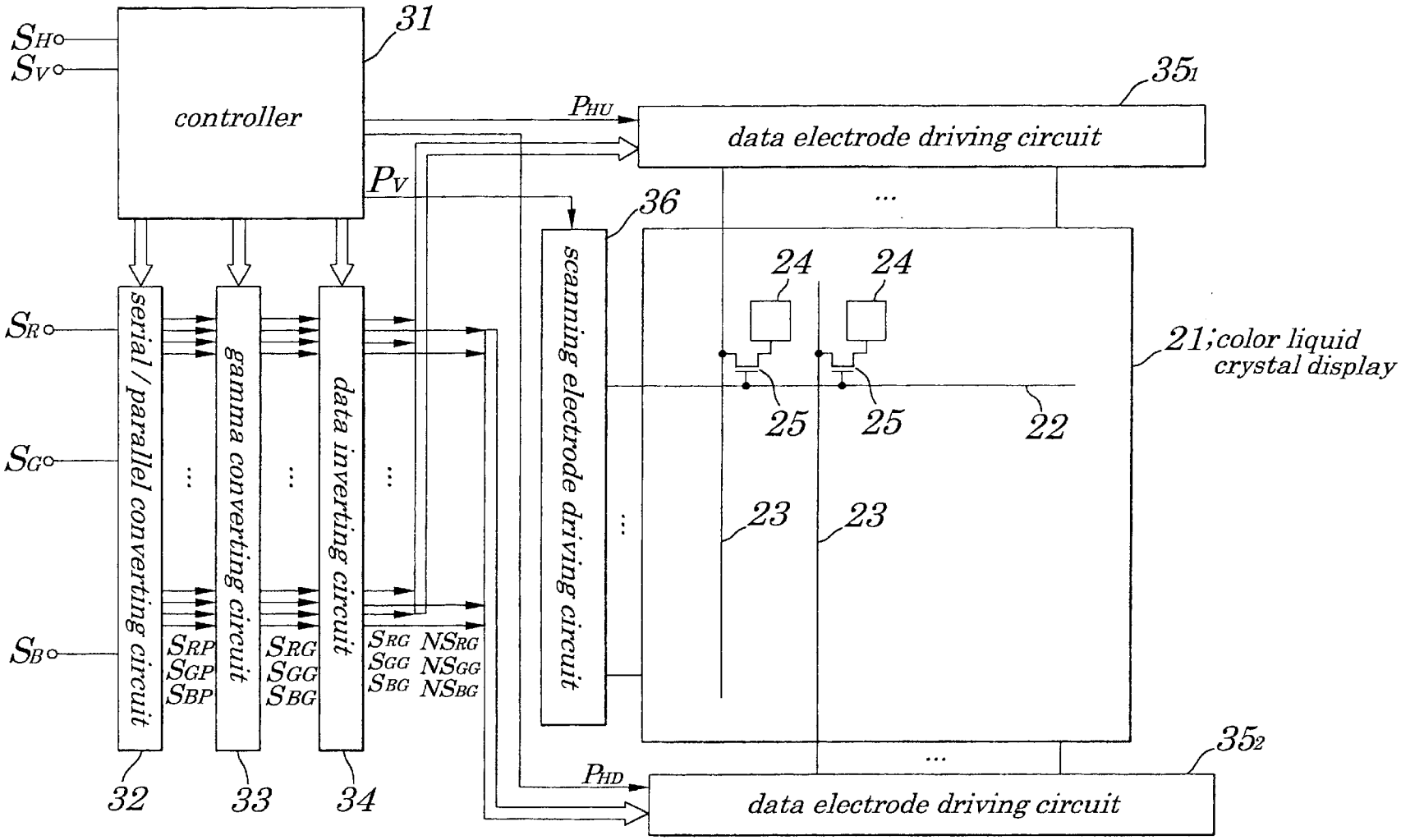
FIG. 10 (PRIOR ART)
FIG. 10 is a schematic block diagram showing configurations of an operating circuit of a conventional liquid crystal display.
Figure 11:
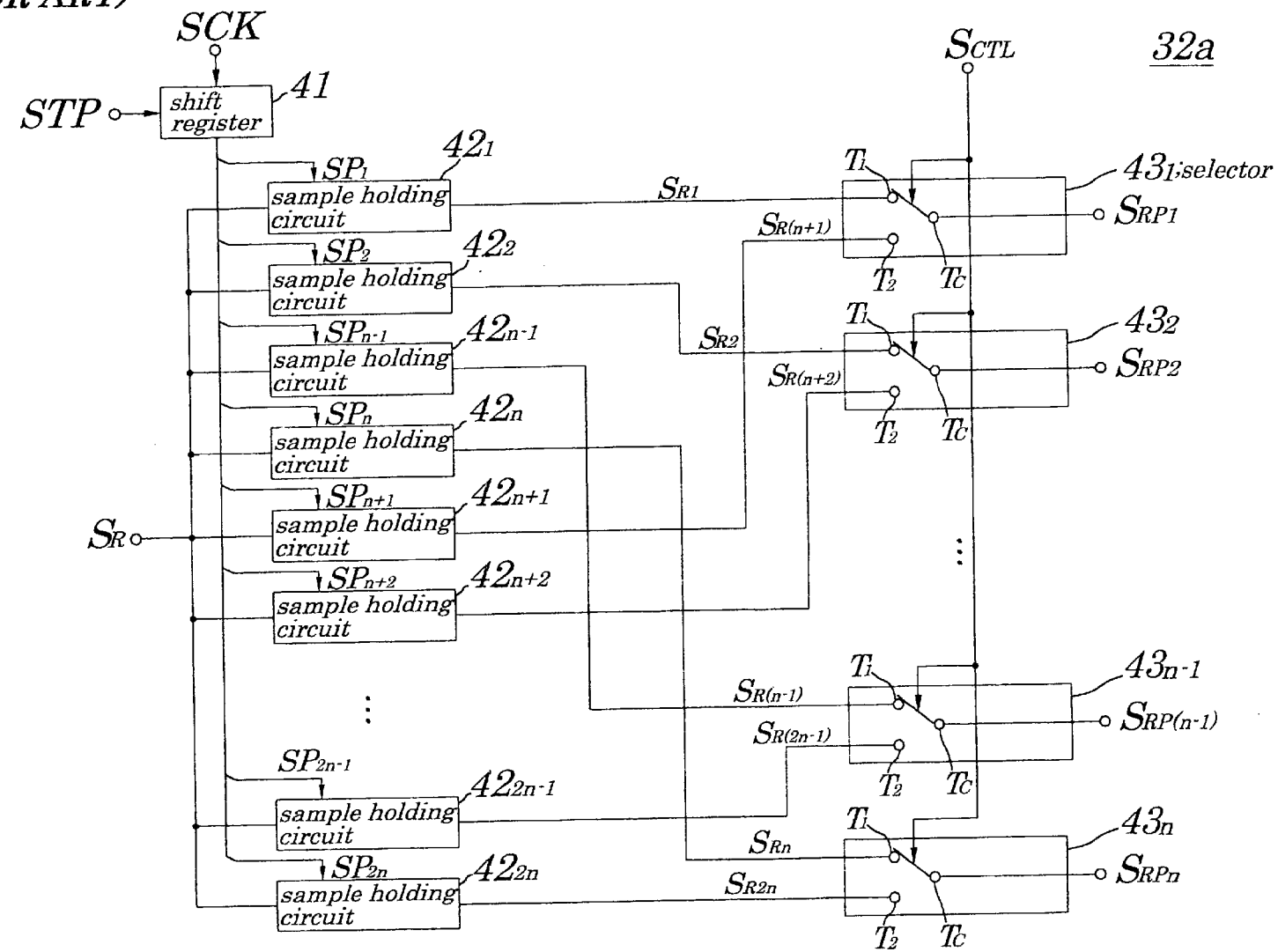
FIG. 11 (PRIOR ART)
FIG. 11 is a circuit diagram showing configurations of a serial/parallel converting section making up a serial/parallel converting circuit in the conventional liquid crystal display.
Figure 12:
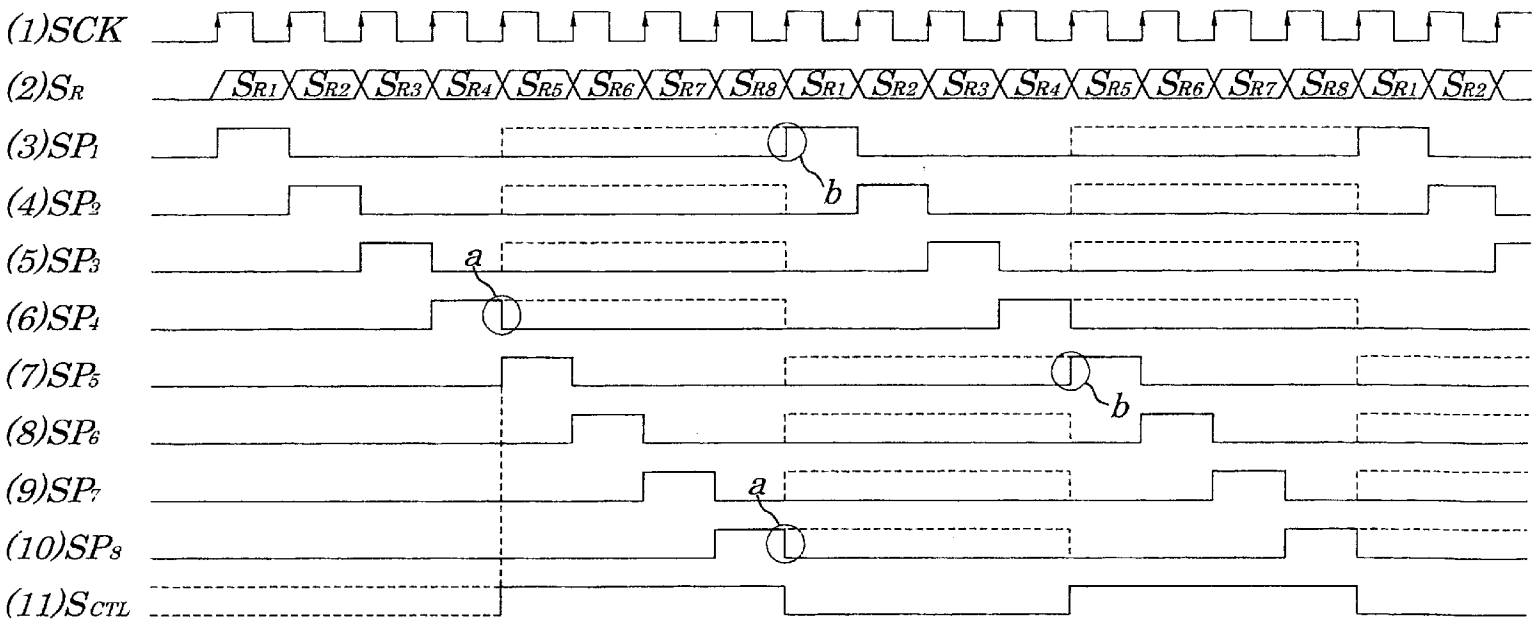
FIG. 12 (PRIOR ART)
FIG. 12 is a timing chart explaining one example of operations of the serial/parallel converting section of FIG. 11.

FIG. 1 is a schematic block diagram showing configurations of a driving circuit of a liquid crystal display according to a first embodiment of the present invention. In FIG. 1, same reference numbers as those in FIG. 10 are assigned to corresponding parts having same functions as those in FIG. 10 and their descriptions are omitted accordingly. The driving circuit of the liquid crystal display shown in FIG. 1 is newly provided with a serial/parallel converting circuit 1, instead of a serial/parallel converting circuit 32 shown in FIG. 10. The serial/parallel converting circuit 1 is made up of serial/parallel converting sections 1*a* (FIG. 2) to 1*c* (1*b* and 1*c* are not shown) each corresponding to each of an analog and serial video red signal $S_R$, an analog and serial video green signal $S_G$, and an analog and serial blue video signal $S_B$ and, under control of a controller 31, is adapted to convert the serial video red signal $S_R$, the serial video green signal $S_G$, and the serial video blue signal $S_B$ into a parallel video red signal $S_{RP}$, a parallel video green signal $S_{GP}$, and a parallel video blue signal $S_{BP}$.

Figure 2:
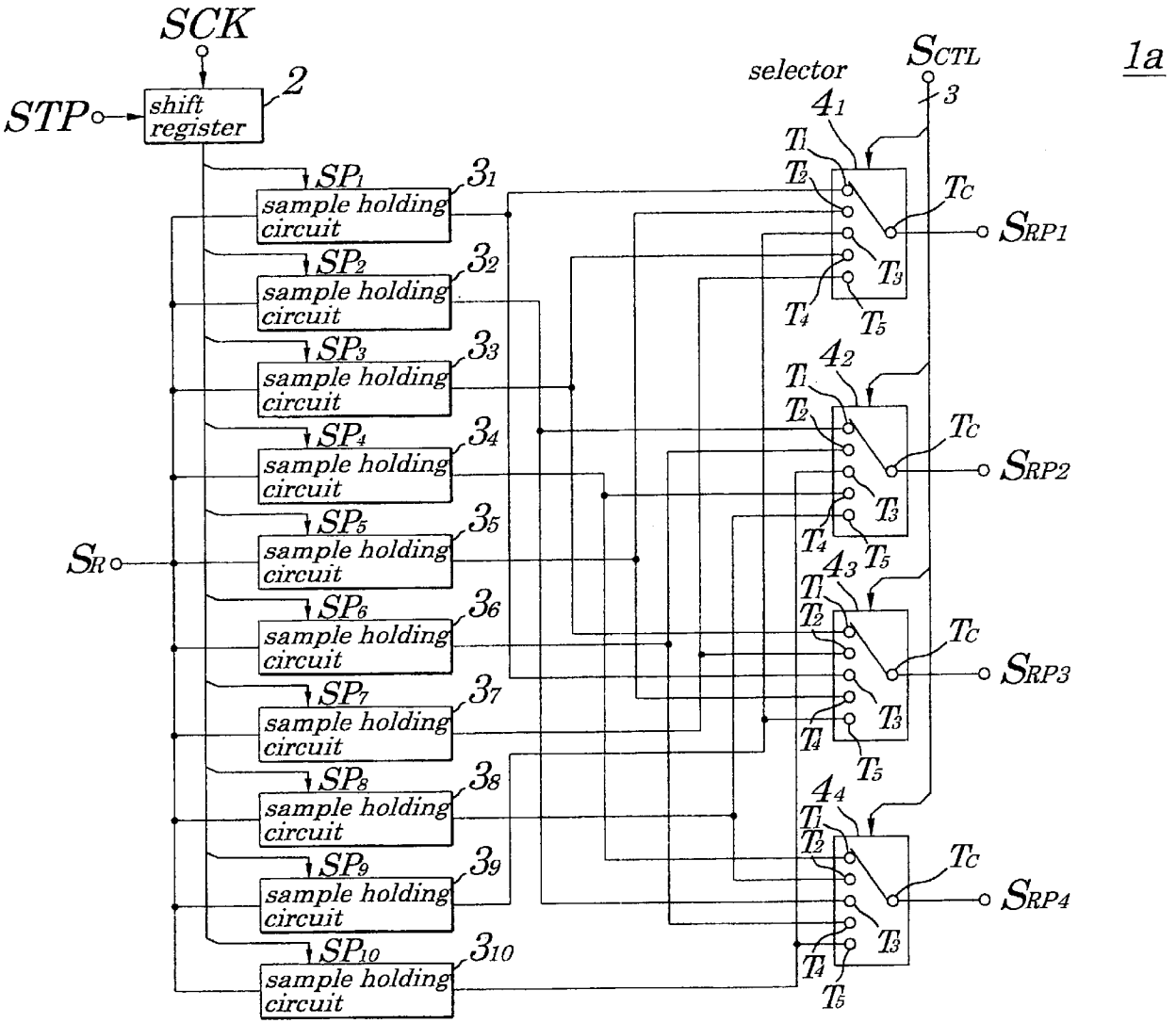
FIG. 2 is a schematic block diagram showing one example of configurations of a serial/parallel converting section making up a serial/parallel converting circuit according to the first embodiment of the present invention.

FIG. 2 is a schematic block diagram showing one example of configurations of the serial/parallel converting section 1*a* making up the serial/parallel converting circuit 1 according to the first embodiment of the present invention. The serial/parallel converting section 1*a* is made up of a shift register 2 and (2n+2) pieces of the sample holding circuits $\mathbf{3}_1$ to $\mathbf{3}_{2n+2}$ in which the number (2n+2) is obtained on an assumption that the analog and serial video red signal $S_R$ fed from outside is expanded so as to become a signal of n-phases ("n" is an integer being two or more) and that the number (2n+2) is set so that it is larger by two than twofold numbers of the phases "n" and of n-pieces (being the same number as that of the phases) of selectors $\mathbf{4}_1$ to $\mathbf{4}_n$ and is adapted to convert, under the control of the controller 31, the analog and serial video red signal $S_R$ into n-pieces of the parallel video red signals $S_{RP1}$ to $S_{RP4}$. Since n=4 in this example, the serial/parallel converting section 1*a* is made up of the shift register 2, ten pieces of the sample holding circuits $\mathbf{3}_1$ to $\mathbf{3}_{10}$ and four pieces of the selectors $\mathbf{4}_1$ to $\mathbf{4}_4$ and is adapted to convert, under the control of the controller 31, the analog and serial video red signals $S_R$ into four pieces of the parallel video red signals $S_{RP1}$ to $S_{RP4}$. In the following descriptions, let it be assumed that n=4.

The shift register 2 is a serial-in and parallel-out type shift register made up of ten pieces of DFF (Delay Flip-flops) (not shown) and is adapted to perform shifting operations to shift a start pulse STP fed from the controller 31 in synchronization with a shift clock SCK fed from the controller 31 and to output each of ten bits of parallel data as sampling pulses $SP_1$ to $SP_{10}$. The sample holding circuits $\mathbf{3}_1$ to $\mathbf{3}_{10}$, based on the corresponding sampling pulses $SP_1$ to $SP_{10}$ fed from the shift register 2, samples voltages $S_{R1}$ to $S_{R10}$ (not shown) of the serial video red signal $S_R$ and then holds each of the sampled voltages $S_{R1}$ to $S_{R10}$ of the serial video red signal $S_R$ for specified period of time. Moreover, though each value of the voltages $S_{R1}$ to $S_{R10}$ in a present period is actually different from each value of the voltages $S_{R1}$ to $S_{R10}$ in a next period, since it is output from the same sample holding circuit 3, same symbols are assigned to these values. The selectors $\mathbf{4}_1$ and $\mathbf{4}_3$, based on three bits of selector control signal $S_{CTL}$ fed from the controller 31, output any one of voltages $S_{R1}$, $S_{R3}$, $S_{R5}$, $S_{R7}$, and $S_{R9}$ (not shown) of the serial video red signal $S_R$ fed respectively from the sample holding circuits $\mathbf{3}_1$, $\mathbf{3}_3$, $\mathbf{3}_5$, $\mathbf{3}_7$, and $S_9$ as parallel video red signals $S_{RP1}$ and $S_{RP3}$. The selectors $\mathbf{4}_2$ and $\mathbf{4}_4$, based on three bits of the selector control signal $S_{CTL}$ fed from the controller 31, output any one of voltages $S_{R2}$, $S_{R4}$, $S_{R6}$, $S_{R8}$, and $S_{R10}$ (not shown) of the serial video red signal $S_R$ fed respectively from the sample holding circuits $\mathbf{3}_2$, $\mathbf{3}_4$, $\mathbf{3}_6$, $\mathbf{3}_8$, and $S_{10}$ as parallel video red signals $S_{RP1}$ and $S_{RP3}$. FIG. 3 is a diagram showing one example of relations between a value of each of $S_{CTL1}$ to $S_{CTL3}$ of the selector control signal $S_{CTL}$ fed to each of the selectors $\mathbf{4}_1$ to $\mathbf{4}_4$ and a voltage value output from the selectors $\mathbf{4}_1$ to $\mathbf{4}_4$ as the parallel video red signals $S_{RP1}$ to $S_{RP4}$. Moreover, configurations of the serial/parallel converting sections 1*b* and 1*c* are the same as those of the serial/parallel converting section 1*a* except that signals to be input and output are different and their descriptions are omitted accordingly.

Next, operations of the serial/parallel converting section 1*a* having configurations as described above will be described by referring to a timing chart shown in FIG. 4. First, when the start pulse STP (not shown) and the shift clock SCK shown in FIG. 4(1) are fed from the controller 31, the shift register 2 performs shifting operations to shift the start pulse STP in synchronization with the shift clock SCK and outputs each of ten bits of parallel data as the sampling pulses $SP_1$ to $SP_{10}$ shown in FIG. 4(3) to FIG. 4(12).

Figure 4:
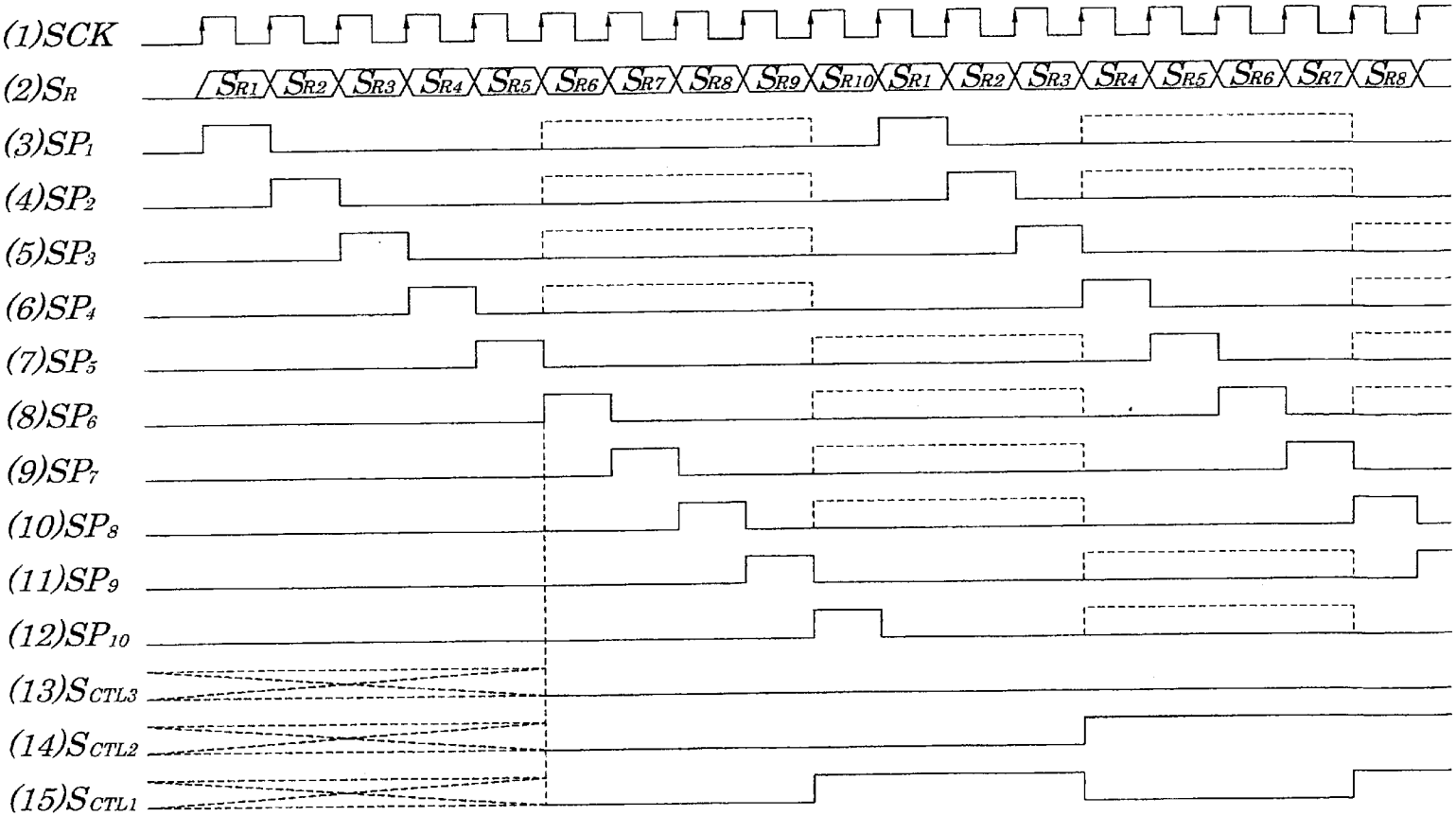
FIG. 4 is a timing chart explaining one example of operations of the serial/parallel converting section of FIG. 2.

Therefore, when the analog and serial video red signal $S_R$ shown in FIG. 4(2) is fed from outside, the sample holding circuit 31, while the sampling pulse $SP_1$ shown in FIG. 4(3) is high, samples the voltage $S_{R1}$ of the serial video red signal $S_R$ and then holds the sampled voltage $S_{R1}$ of the serial video red signal $S_R$ while the sampling pulse $SP_1$ is low. The video red signal $S_R$, though it is an analog signal, to simplify description, is expressed as if it were digital data in FIG. 4(2). Similarly, the sample holding circuit $\mathbf{3}_2$, while the sampling pulse $SP_2$ shown in FIG. 4(4) is high, samples the voltage $S_{R2}$ of the serial video red signal $S_R$ and then holds the sampled voltage $S_{R2}$ of the serial video red signal $S_R$ while the sampling pulse $SP_2$ is low. The sample holding circuit 33, while the sampling pulse $SP_3$ shown in FIG. 4(5) is high, samples the voltage $S_{R3}$ of the serial video red signal $S_R$ and then holds the sampled voltage $S_{R3}$ of the serial video red signal $S_R$ while the sampling pulse $SP_3$ is low. The sample holding circuit $\mathbf{3}_4$, while the sampling pulse $SP_4$ shown in FIG. 4(6) is high, samples the voltage $S_{R4}$ of the serial video red signal $S_R$ and then holds the sampled voltage $S_{R4}$ of the serial video red signal $S_R$ while the sampling pulse $SP_4$ is low.

Next, when each bit of the $S_{CTL1}$ to $S_{CTL3}$ of the selector control signal $S_{CTL}$ fed from the controller 31 is changed to be low in synchronization with a sixth rise of the shift clock SCK as shown in FIG. 4(13) to FIG. 4(15), the selectors $\mathbf{4}_1$ to $\mathbf{4}_4$, based on the selector control signal $S_{CTL}$, by connecting each of common terminals $T_c$ to a first terminal $T_1$, during periods being surrounded by broken lines shown in the left part of FIG. 4(3) to FIG. 4(6), output the voltages $S_{R1}$ to $S_{R4}$ of the serial video red signal $S_R$ held by each of the corresponding sample holding circuits $\mathbf{3}_1$ to $\mathbf{3}_4$ as parallel video red signals $S_{RP1}$ to $S_{RP4}$ (refer to a first row in FIG. 3).

Next, the sample holding circuit $\mathbf{3}_5$, while the sampling pulse $SP_5$ shown in FIG. 4(7) is high, samples the voltage $S_{R5}$ of the serial video red signal $S_R$ and then holds the sampled voltage $S_{R5}$ of the serial video red signal $S_R$ while the sampling pulse $SP_5$ is low. Similarly, the sample holding circuit $\mathbf{3}_6$, while the sampling pulse $SP_6$ shown in FIG. 4(8) is high, samples the voltage $S_{R6}$ of the serial video red signal $S_R$ and then holds the sampled voltage $S_{R6}$ of the serial video red signal $S_R$ while the sampling pulse $SP_6$ is low. The sample holding circuit $\mathbf{3}_7$, while the sampling pulse $SP_7$ shown in FIG. 4(9) is high, samples the voltage $S_{R7}$ of the serial video red signal $S_R$ and then holds the sampled voltage $S_{R7}$ of the serial video red signal $S_R$ while the sampling pulse $SP_7$ is low. The sample holding circuit $\mathbf{3}_8$, while the sampling pulse $SP_8$ shown in FIG. 4(10) is high, samples the voltage $S_{R8}$ of the serial video red signal $S_R$ and then holds the sampled voltage $S_{R8}$ of the serial video red signal $S_R$ while the sampling pulse $SP_8$ is low.

Then, when only the bit value of the $S_{CTL1}$ of the selector control signal $S_{CTL}$ fed from the controller 31 is changed to be high in synchronization with a tenth rise of the shift clock SCK as shown in FIG. 4(13) to FIG. 4(15), the selectors $\mathbf{4}_1$ to $\mathbf{4}_4$, based on the selector control signal $S_{CTL}$, by connecting each of common terminals $T_c$ to a second terminal $T_2$, during periods being surrounded by broken lines shown in the left part of FIG. 4(7) to FIG. 4(10), output the voltages $S_{R5}$ to $S_{R6}$ of the serial video red signal $S_R$ held by each of the corresponding sample holding circuits $\mathbf{3}_5$ to $\mathbf{3}_8$ as parallel video red signals $S_{RP1}$ to $S_{RP4}$ (refer to a second row in FIG. 3).

Next, the sample holding circuit $\mathbf{3}_9$, while the sampling pulse $SP_9$ shown in FIG. 4(11) is high, samples the voltage $S_{R9}$ of the serial video red signal $S_R$ and then holds the sampled voltage $S_{R9}$ of the serial video red signal $S_R$ while the sampling pulse $SP_9$ is low. Similarly, the sample holding circuit $3_{10}$, while the sampling pulse $SP_{10}$ shown in FIG. 4(12) is high, samples the voltage $S_{R10}$ of the serial video red signal $S_R$ and then holds the sampled voltage $S_{R10}$ of the serial video red signal $S_R$ while the sampling pulse $SP_{10}$ is low. The sample holding circuit $3_1$, while the sampling pulse $SP_1$ shown in FIG. 4(3) becomes high next, samples the voltage $S_{R1}$ of the serial video red signal $S_R$ and then holds the sampled voltage $S_{R1}$ of the serial video red signal $S_R$ while the sampling pulse $SP_1$ becomes low next. The sample holding circuit 32, while the sampling pulse $SP_2$ shown in FIG. 4(4) becomes high next, samples the voltage $S_{R2}$ of the serial video red signal $S_R$ and then holds the sampled voltage $S_{R2}$ of the serial video red signal $S_R$ while the sampling pulse $SP_2$ becomes low next.

Then, when the bit value of the $S_{CTL2}$ of the selector control signal $S_{CTL}$ fed from the controller 31 is changed to be high and the bit value of the $S_{CTL1}$ is changed to be low in synchronization with a fourteenth rise of the shift clock SCK as shown in FIG. 4(13) to FIG. 4(15), the selectors $4_1$ to $4_4$, based on the selector control signal $S_{CTL}$, by connecting each of common terminals $T_c$ to a third terminal $T_3$, during periods being surrounded by broken lines shown in FIGS. 4(11) and (12) and during periods being surrounded by broken lines shown in the right part of FIG. 4(3) to FIG. 4(4), output the voltages $S_{R9}$, $S_{R10}$, $S_{R1}$, and $S_{R2}$ of the serial video red signal $S_R$ held by each of the corresponding sample holding circuits $3_9$, $3_{10}$, $3_1$, and $3_2$ as parallel video red signals $S_{RP1}$ to $S_{RP4}$ (refer to a third row in FIG. 3).

Next, the sample holding circuit $3_3$, while the sampling pulse $SP_3$ shown in FIG. 4(5) is high, samples the voltage $S_{R3}$ of the serial video red signal $S_R$ and then holds the sampled voltage $S_{R3}$ of the serial video red signal $S_R$ while the sampling pulse $SP_3$ is low. The sample holding circuit $3_4$, while the sampling pulse $SP_4$ shown in FIG. 4(6) becomes high next, samples the voltage $S_{R4}$ of the serial video red signal $S_R$ and then holds the sampled voltage $S_{R4}$ of the serial video red signal $S_R$ while the sampling pulse $SP_4$ becomes low next. The sample holding circuit $3_5$, while the sampling pulses $SP_5$ shown in FIG. 4(7) becomes high next, samples the voltage $S_{R5}$ of the serial video red signal $S_R$ and then holds the sampled voltage $S_{R5}$ of the serial video red signal $S_R$ while the sampling pulse $SP_5$ becomes low next. The sample holding circuit $3_6$, while the sampling pulse $SP_6$ shown in FIG. 4(8) becomes high next, samples the voltage $S_{R6}$ of the video serial red signal $S_R$ and then holds the sampled voltage $S_{R6}$ of the serial video red signal $S_R$ while the sampling pulse $SP_6$ becomes low next.

Then, when the bit value of the $S_{CTL1}$ of the selector control signal $S_{CTL}$ fed from the controller 31 is changed to be high in synchronization with an eighth rise of the shift clock SCK as shown in FIG. 4(13) to FIG. 4(15), the selectors $4_1$ to $4_4$, based on the selector control signal $S_{CTL}$, by connecting each of common terminals $T_c$ to a fourth terminal $T_4$, during periods being surrounded by broken lines shown in the right part of FIG. 4(5) to FIG. 4(8), output the voltages $S_{R3}$ to $S_{R6}$ of the serial video red signal $S_R$ held by each of the corresponding sample holding circuits $3_3$ to $3_6$ as parallel video red signals $S_{RP1}$ to $S_{RP4}$ (refer to a fourth row in FIG. 3).

Next, the sample holding circuit $3_7$, while the sampling pulse $SP_7$ shown in FIG. 4(9) becomes high next, samples the voltage $S_{R7}$ of the serial video red signal $S_R$ and then holds the sampled voltage $S_{R7}$ of the serial video red signal $S_R$ while the sampling pulse $SP_7$ becomes low next. Similarly, the sample holding circuit $3_8$, while the sampling pulse $SP_8$ shown in FIG. 4(10) becomes high next, samples the voltage $S_{R8}$ of the serial video red signal $S_R$ and then holds the sampled voltage $S_{R8}$ of the serial video red signal $S_R$ while the sampling pulse $SP_8$ becomes low next. The sample holding circuit $3_9$, while the sampling pulse $SP_9$ shown in FIG. 4(11) becomes high next, samples the voltage $S_{R9}$ of the serial video red signal $S_R$ and then holds the sampled voltage $S_{R9}$ of the serial video red signal $S_R$ while the sampling pulse $SP_9$ becomes low next. The sample holding circuit $3_{10}$, while the sampling pulse $SP_{10}$ shown in FIG. 4(12) becomes high next, samples the voltage $S_{R10}$ of the serial video red signal $S_R$ and then holds the sampled voltage $S_{R10}$ of the serial video red signal $S_R$ while the sampling pulse $SP_{10}$ becomes low next.

Then, when the bit value of the $S_{CTL1}$ and $S_{CTL2}$ of the selector control signal $S_{CTL}$ fed from the controller 31 are changed to be low and the bit value of the $S_{CTL3}$ is changed to be high, the selectors $4_1$ to $4_4$, based on the selector control signal $S_{CTL}$, by connecting each of common terminals $T_c$ to a fifth terminal $T_5$, output the voltages $S_{R7}$ to $S_{R10}$ of the serial video red signal $S_R$ held by each of the corresponding sample holding circuits $3_7$ to $3_{10}$ as parallel video red signals $S_{RP1}$ to $S_{RP4}$ (refer to a fifth row in FIG. 3). Hereinafter, the same processing is sequentially repeated. Operations for the serial video green signal $S_G$ and the serial video blue signal $S_B$ are the same as those for the video red signal $S_R$.

Thus, in the configurations of the embodiment described above, the (2n+2) pieces of the sample holding circuits $3_1$ to $3_{2n+2}$, the number of which is larger by two than twofold numbers of phases "n", that is, the number of the sample holding circuits 3 being larger by two than that in the conventional sample holding circuit, are provided and the "n" pieces of the selectors 4, the number of which is the same as the number of the phases "n", used to select one input signal out of (n+1) pieces of the signals, the number of which is larger by one than the number of the phases "n", and, moreover, after all voltages of the serial video red signal $S_R$ for every "n" pieces of the signals that should be expanded so as to become "n" phases have been sampled, while all the voltages are being held and during the period excluding the period being equivalent to one clock of the shift clock being supplied before and after, the selector 4 is switched based on the selector control signal $S_{CTL}$.

Therefore, even if settling time is great due to the capacitance of the capacitor making up each of the sample holding circuits 3, even if the switching speed of the selector is low, even if the selector control signal $S_{CTL}$ rises earlier than the each of the sampling pulses SP falls due to the delay in the signal transmission caused by the routing of the wirings or even if the selector control signal $S_{CTL}$ falls later than the sampling pulse SP rises, no switching of the selector $4_1$ to $4_n$ occurs during the sampling period of the voltage of each of the video red signals $S_R$. This prevents noise that should not be displayed from being displayed on the color liquid crystal display 21 as inconsistencies in displaying.

Moreover, unlike in the conventional case, fine calibration of rising and falling of the selector control signal $S_{CTL}$ is not necessary. As a result, there are neither influences by delay in signal transmission caused by routing of wirings, nor influences by dispersion in capacitance of a capacitor making up each of the sample holding circuits 3 and by dispersion in parasitic capacitance of transistors serving as switching devices, nor influences by dispersion in switching speed of the selector 4, thus eliminating needs for workers having skill of finely calibrating timing of the rising and falling of the selector control signals $S_{CTL}$. Even when a UXGA-type liquid crystal display is driven, all that needs to be done is to increase the number of the sample holding circuits by two pieces per one color of the video signal and it is not necessary to increase the number of phases that are expanded, thus preventing the driving circuit of the color liquid crystal display 21 from becoming costly and also preventing the routing of wirings used to supply signals of many phases to the data electrode driving circuits $\mathbf{35}_1$ and $\mathbf{35}_2$ from being made complicated, which serves to avoid a large-sized liquid crystal display. Furthermore, even if the data electrode driving circuits $\mathbf{35}_1$ and $\mathbf{35}_2$ and the scanning electrode driving circuit 36 are constructed of ICs fabricated using polysilicon having high on-resistance and slow operation speed or even if the data electrode driving circuits $\mathbf{35}_1$ and $\mathbf{35}_2$ and the scanning electrode driving circuit 36 are fabricated, using polysilicon, on glass substrate on which the color liquid crystal display 21 is formed, satisfactory operations can be implemented. This enables satisfactory handling of the serial video signal having high frequencies in the liquid crystal display with high definition.

Thus, according to the embodiment of the present invention, there is provided the driving circuit of the liquid crystal display configured at low costs and being small in size, which is capable of converting the analog and serial video signal having a high resolution into the parallel video signal, which enables high-quality images to be displayed with high resolutions without inconsistencies in displaying.

Second Embodiment

Figure 5:
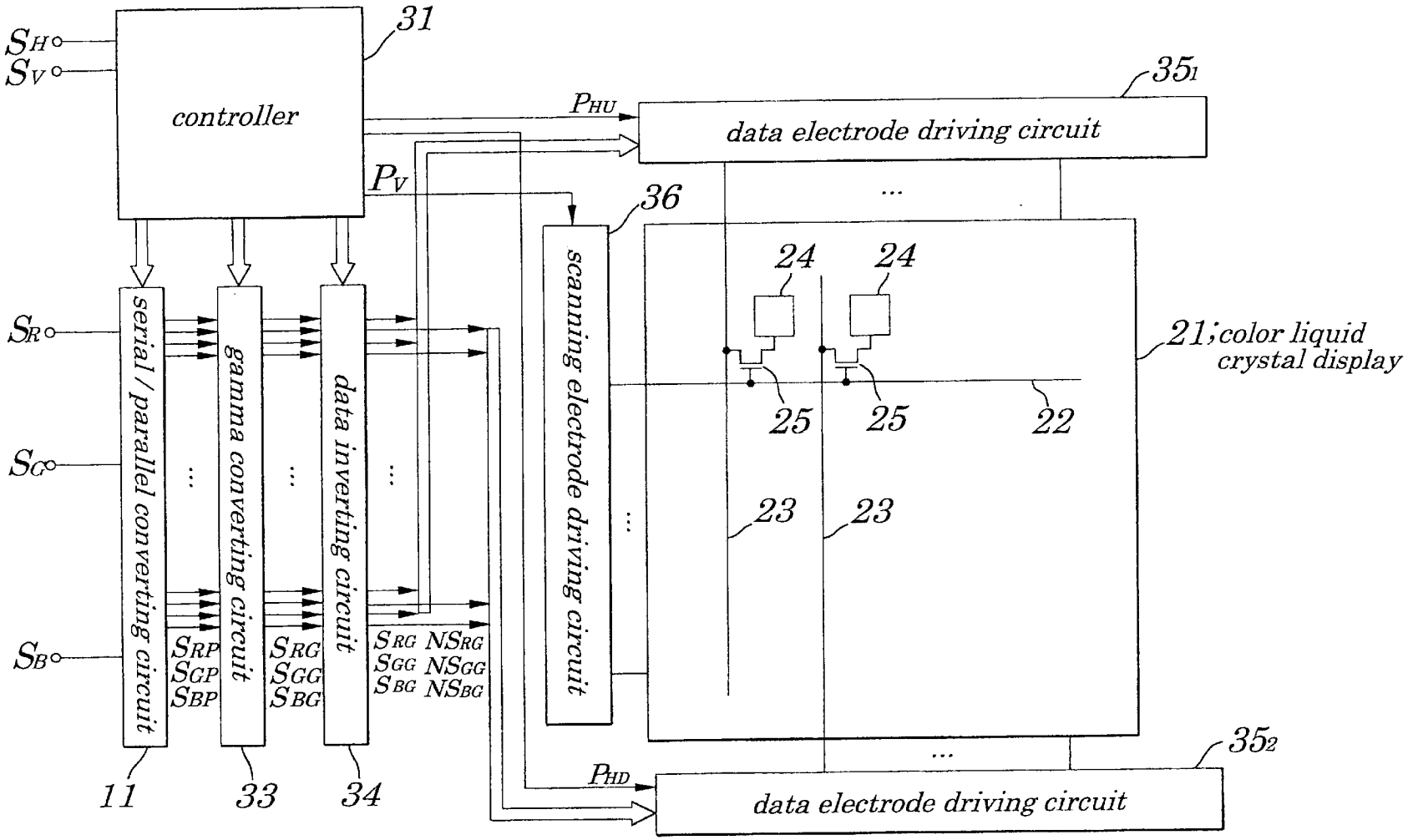
FIG. 5 is a schematic block diagram showing configurations of a driving circuit of a liquid crystal display according to a second embodiment of the present invention.

FIG. 5 is a schematic block diagram showing configurations of a driving circuit of a color liquid crystal display according to a second embodiment of the present invention. In FIG. 5, same reference numbers as those in FIG. 1 are assigned to corresponding parts having same functions as those in FIG. 1 and their descriptions are omitted accordingly. The driving circuit of the color liquid crystal display shown in FIG. 5 is newly provided with a serial/parallel converting circuit 11, instead of a serial/parallel converting circuit 1 shown in FIG. 1. The serial/parallel converting circuit 11 is made up of serial/parallel converting sections 11*a* (shown in FIG. 6) to 11*c* (11*b*, 11*c* not shown) each corresponding to each of an analog and serial video red signal $S_R$, an analog and serial video green signal $S_G$, and an analog and serial blue video signal $S_B$ and, under a control of a controller 31, is adapted to convert the analog and serial video red signal $S_R$, analog and serial video green signal $S_G$, and analog and serial video blue signal $S_B$ into a parallel video red signal $S_{RP}$, a parallel video green signal $S_{GP}$, and a parallel video blue signal $S_{BP}$.

Figure 6:
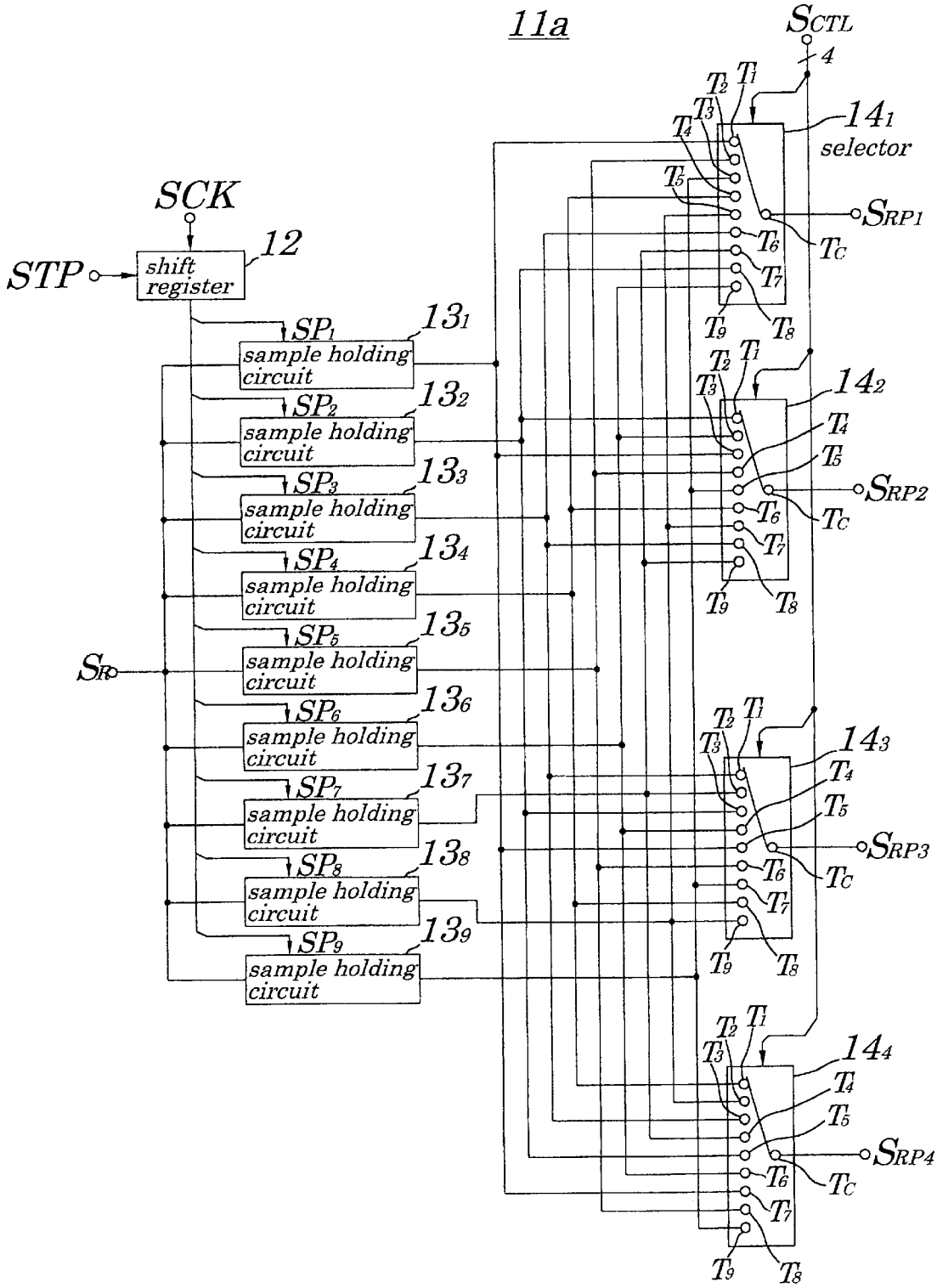
FIG. 6 is a schematic block diagram showing one example of configurations of a serial/parallel converting section making up a serial/parallel converting circuit according to the second embodiment of the present invention.

Next, FIG. 6 is a schematic block diagram showing one example of configurations of the serial/parallel converting section 11*a* making up the serial/parallel converting circuit 11 according to the second embodiment of the present invention. The serial/parallel converting section 11*a* is made up of a shift register 12 and (2n+1) pieces of sample holding circuits $\mathbf{13}_1$ to $\mathbf{13}_{2n+1}$ in which the number (2n+1) is obtained on an assumption that the analog and serial video red signal $S_R$ fed from outside is expanded so as to become a signal of n-phases (n is an integer being two or more) and that the number (2n+1) is set so that it is larger by one than twofold numbers of phases "n" and of n-pieces (being the same number as that of the phases) of selectors $\mathbf{14}_1$ to $\mathbf{14}_n$ and is adapted to convert, under control of the controller 31, the analog and serial video red signal $S_R$ into n-pieces of parallel video signals $S_{RP1}$ to $S_{RPn}$. Since n=4 in this example, the serial/parallel converting section 11*a* is made up of the shift register 12, nine pieces of the sample holding circuits $\mathbf{13}_1$ to $\mathbf{13}_9$ and four pieces of the selectors $\mathbf{14}_1$ to $\mathbf{14}_4$ and is adapted to convert, under the control of the controller 31, the analog and serial video red signals $S_R$ into four pieces of the parallel video signals $S_{RP1}$ to $S_{RP4}$. In the following descriptions, let it be assumed that n=4.

The shift register 12 is a serial-in and parallel-out type shift register made up of nine pieces of DFF (Delay Flip-flops) and is adapted to perform shifting operations to shift a start pulse STP fed from the controller 31 in synchronization with the shift clock SCK fed from the controller 31 and to output each of nine bits of parallel data as sampling pulses $SP_1$ to $SP_9$. The sample holding circuits $\mathbf{13}_1$ to $\mathbf{13}_9$, based on the corresponding sampling pulses $SP_1$ to $SP_9$ fed from the shift register 12, sample voltages $S_{R1}$ to $S_{R9}$ (not shown) of the serial video red signal $S_R$ and then holds each of the sampled voltages $S_{R1}$ to $S_{R9}$ of the serial video red signal $S_R$ for a specified period of time. Moreover, though each value of the voltages $S_{R1}$ to $S_{R9}$ in a present period is actually different from each value of the voltages $S_{R1}$ to $S_{R9}$ in a next period, since it is output from the same sample holding circuit 13, same symbols are assigned to these values. The selectors $\mathbf{14}_1$ and $\mathbf{14}_3$, based on four bits of selector control signal $S_{CTL}$ fed from the controller 31, output any one of voltages $S_{R1}$ to $S_{R9}$ of the serial video red signal $S_R$ fed respectively from the sample holding circuits $\mathbf{13}_1$ to $\mathbf{13}_9$ as parallel video signals $S_{RP1}$ to $S_{RP4}$.

FIG. 7 is a diagram showing one example of relations between a value of each of $S_{CTL1}$ to $S_{CTL4}$ of the selector control signal $S_{CTL}$ fed to each of the selectors $\mathbf{14}_1$ to $\mathbf{14}_4$ and a voltage value output from the selectors $\mathbf{14}_1$ to $\mathbf{14}_4$ as parallel video red signals $S_{RP1}$ to $S_{RP4}$ according to the second embodiment of the present invention. Moreover, configurations of the serial/parallel converting sections 11*b* and 11*c* (not shown) are the same as those of the serial/parallel converting section 11*a* except that signals to be input and output are different and their descriptions are omitted accordingly.

Next, operations of the serial/parallel converting section 11*a* having configurations as described above will be described by referring to a timing chart shown in FIG. 8. First, when the start pulse STP (not shown) and the shift clock SCK shown in FIG. 8(1) are fed from the controller 31, the shift register 12 performs shifting operations to shift the start pulse STP in synchronization with the shift clock SCK and outputs each of nine bits of parallel data as the sampling pulses $SP_1$ to $SP_9$ shown in FIG. 8(3) to FIG. 8(11).

Figure 8:
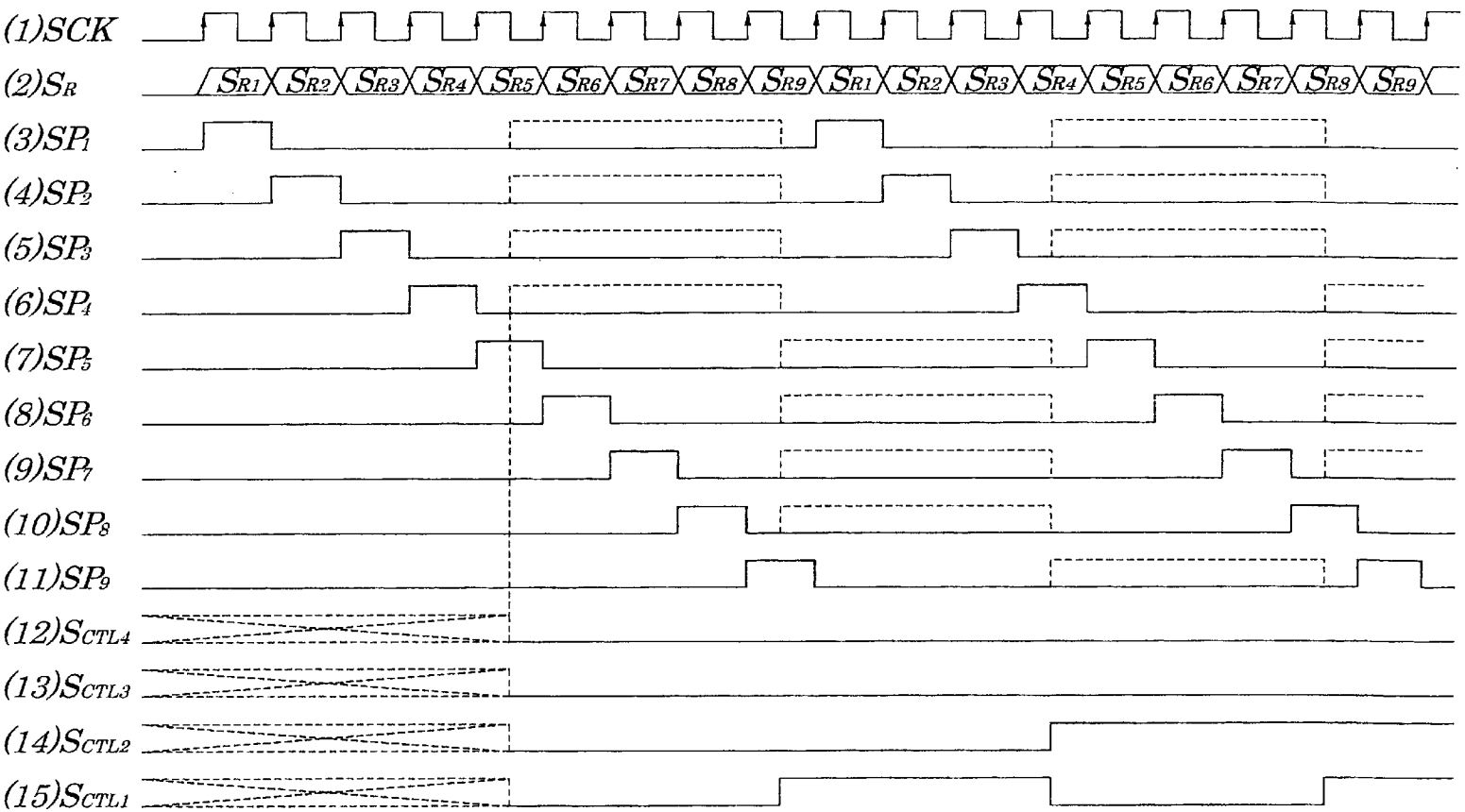
FIG. 8 is a timing chart explaining one example of operations of the serial/parallel converting section of FIG. 6.

Therefore, when the analog and serial video red signal $S_R$ shown in FIG. 8(2) is fed from outside, the sample holding circuit $\mathbf{13}_1$, while the sampling pulse $SP_1$ shown in FIG. 8(3) becomes high for a first time, samples the voltage $S_{R1}$ of the serial video red signal $S_R$ and then holds the sampled voltage $S_{R1}$ of the serial video red signal $S_R$ while the sampling pulse $SP_1$ becomes low for a first time. The video red signal $S_R$, though it is an analog signal, to simplify description, is expressed as if each of the voltages $S_{R1}$ to $S_{R9}$ were digital data in FIG. 8(2). Similarly, the sample holding circuit $\mathbf{13}_2$, while the sampling pulse $SP_2$ shown in FIG. 8(4) becomes high for a first time, samples the voltage $S_{R2}$ of the serial video red signal $S_R$ and then holds the sampled voltage $S_{R2}$ of the serial video red signal $S_R$ while the sampling pulse $SP_2$ becomes low for a first time. The sample holding circuit $\mathbf{13}_3$, while the sampling pulse $SP_3$ shown in FIG. 8(5) becomes high for a first time, samples the voltage $S_{R3}$ of the serial video red signal $S_R$ and then holds the sampled voltage $S_{R3}$ of the serial video red signal $S_R$ while the sampling pulse $SP_3$ becomes low for a first time. The sample holding circuit $13_4$, while the sampling pulse $SP_4$ shown in FIG. 8(6) becomes high for a first time, samples the voltage $S_{R4}$ of the serial video red signal $S_R$ and then holds the sampled voltage $S_{R4}$ of the serial video red signal $S_R$ while the sampling pulse $SP_4$ becomes low for a first time.

Next, when each bit of the $S_{CTL1}$ to $S_{CTL4}$ of the selector control signal $S_{CTL}$ fed from the controller 31 is changed to be low in synchronization with a fifth fall of the shift clock SCK as shown in FIG. 8(12) to FIG. 8(15), the selectors $14_1$ to $14_4$, based on the selector control signal $S_{CTL}$, by connecting each of common terminals $T_c$ to a first terminal $T_1$, during periods being surrounded by broken lines shown in the left part of FIG. 8(3) to FIG. 8(6), output the voltages $S_{R1}$ to $S_{R4}$ of the serial video red signal $S_R$ held by each of the corresponding sample holding circuits $13_1$ to $13_4$ as parallel video red signals $S_{RP1}$ to $S_{RP4}$ (refer to a first row in FIG. 7).

The sample holding circuit $13_5$, while the sampling pulse $SP_5$ shown in FIG. 8(7) becomes high for a first time, samples the voltage $S_{R5}$ of the serial video red signal $S_R$ and then holds the sampled voltage $S_{R5}$ of the serial video red signal $S_R$ while the sampling pulse $SP_5$ becomes low for a first time. Similarly, the sample holding circuit $13_6$, while the sampling pulse $SP_6$ shown in FIG. 8(8) becomes high for a first time, samples the voltage $S_{R6}$ of the serial video red signal $S_R$ and then holds the sampled voltage $S_{R6}$ of the serial video red signal $S_R$ while the sampling pulse $SP_6$ becomes low for a first time. The sample holding circuit $13_7$, while the sampling pulse $SP_7$ shown in FIG. 8(9) becomes high for a first time, samples the voltage $S_{R7}$ of the serial video red signal $S_R$ and then holds the sampled voltage $S_{R7}$ of the serial video red signal $S_R$ while the sampling pulse $SP_7$ becomes low for a first time. The sample holding circuit $13_8$, while the sampling pulse $SP_8$ shown in FIG. 8(10) becomes high for a first time, samples the voltage $S_{R8}$ of the serial video red signal $S_R$ and then holds the sampled voltage $S_{R8}$ of the serial video red signal $S_R$ while the sampling pulse $SP_8$ becomes low for a first time.

Then, when only the bit value of the $S_{CTL1}$ of the selector control signal $S_{CTL}$ fed from the controller 31 is changed to be high in synchronization with a ninth fall of the shift clock SCK as shown in FIG. 8(12) to FIG. 8(15), the selectors $14_1$ to $14_4$, based on the selector control signal $S_{CTL}$, by connecting each of common terminals $T_c$ to a second terminal $T_2$, during periods being surrounded by broken lines shown in the left part of FIG. 8(7) to FIG. 8(10), output the voltages $S_{R5}$ to $S_{R8}$ of the serial video red signal $S_R$ held by each of the corresponding sample holding circuits $13_5$ to $13_8$ as parallel video red signals $S_{RP1}$ to $S_{RP4}$ (refer to a second row in FIG. 7).

Next, the sample holding circuit $13_9$, while the sampling pulse $SP_9$ shown in FIG. 8(11) becomes high for a first time, samples the voltage $S_{R9}$ of the serial video red signal $S_R$ and then holds the sampled voltage $S_{R9}$ of the serial video red signal $S_R$ while the sampling pulse $SP_9$ becomes low for a first time. Similarly, the sample holding circuit $13_1$, while the sampling pulse $SP_1$ shown in FIG. 8(3) becomes high for a second time, samples the voltage $S_{R1}$ of the serial video red signal $S_R$ and then holds the sampled voltage $S_{R1}$ of the serial video red signal $S_R$ while the sampling pulse $SP_1$ becomes low for a second time. The sample holding circuit $13_2$, while the sampling pulse $SP_2$ shown in FIG. 8(4) becomes high for a second time, samples the voltage $S_{R2}$ of the serial video red signal $S_R$ and then holds the sampled voltage $S_{R2}$ of the serial video red signal $S_R$ while the sampling pulse $SP_2$ becomes low for a second time. The sample holding circuit $13_3$, while the sampling pulse $SP_3$ shown in FIG. 8(5) becomes high for a second time, samples the voltage $S_{R3}$ of the serial video red signal $S_R$ and then holds the sampled voltage $S_{R3}$ of the serial video red signal $S_R$ while the sampling pulse $SP_3$ becomes low for a second time.

Then, when the bit value of the $S_{CTL2}$ of the selector control signal $S_{CTL}$ fed from the controller 31 is changed to be high in synchronization with a third fall of the shift clock SCK as shown in FIG. 8(12) to FIG. 8(15), the selectors $14_1$ to $14_4$, based on the selector control signal $S_{CTL}$, by connecting each of common terminals $T_c$ to a third terminal $T_3$, during periods being surrounded by broken lines shown in FIG. 8(11) and during periods being surrounded by broken lines shown in the left part of FIG. 8(3) to FIG. 8(5), output the voltages $S_{R9}$, $S_{R1}$, $S_{R2}$, and $S_{R3}$ of the serial video red signal $S_R$ held by each of the corresponding sample holding circuits $13_9$, $13_1$, $13_2$, and $13_3$ as parallel video red signals $S_{RP1}$ to $S_{RP4}$ (refer to a third row in FIG. 7).

Next, the sample holding circuit $13_4$, while the sampling pulse $SP_4$ shown in FIG. 8(6) becomes high for a second time, samples the voltage $S_{R4}$ of the serial video red signal $S_R$ and then holds the sampled voltage $S_{R4}$ of the serial video red signal $S_R$ while the sampling pulse $SP_4$ becomes low for a second time. Similarly, the sample holding circuit $13_5$, while the sampling pulse $SP_5$ shown in FIG. 8(7) becomes high for a second time, samples the voltage $S_{R5}$ of the serial video red signal $S_R$ and then holds the sampled voltage $S_{R5}$ of the serial video red signal $S_R$ while the sampling pulse $SP_5$ becomes low for a second time. The sample holding circuit $13_6$, while the sampling pulse $SP_6$ shown in FIG. 8(8) becomes high for a second time, samples the voltage $S_{R6}$ of the serial video red signal $S_R$ and then holds the sampled voltage $S_{R6}$ of the serial video red signal $S_R$ while the sampling pulse $SP_6$ becomes low for a second time. The sample holding circuit $13_7$, while the sampling pulse $SP_7$ shown in FIG. 8(9) becomes high for a second time, samples the voltage $S_{R7}$ of the serial video red signal $S_R$ and then holds the sampled voltage $S_{R7}$ of the serial video red signal $S_R$ while the sampling pulse $SP_7$ becomes low for a second time.

Then, when the bit value of the $S_{CTL1}$ of the selector control signal $S_{CTL}$ fed from the controller 31 is changed to be high in synchronization with a seventeenth fall of the shift clock SCK as shown in FIG. 8(12) to FIG. 8(15), the selectors $14_1$ to $14_4$, based on the selector control signal $S_{CTL}$, by connecting each of common terminals $T_c$ to a fourth terminal $T_4$, during periods being surrounded by broken lines shown in the right part of FIG. 8(6) to FIG. 8(9), output the voltages $S_{R4}$ to $S_{R7}$ of the serial video red signal $S_R$ held by each of the corresponding sample holding circuits $13_4$ to $13_7$ as parallel video red signals $S_{RP1}$ to $S_{RP4}$ (refer to a fourth row in FIG. 7).

Next, the sample holding circuit $13_8$, while the sampling pulse $SP_8$ shown in FIG. 8(10) becomes high for a second time, samples the voltage $S_{R8}$ of the serial video red signal $S_R$ and then holds the sampled voltage $S_{R8}$ of the serial video red signal $S_R$ while the sampling pulse $SP_8$ becomes low for a second time. Similarly, the sample holding circuit $13_9$, while the sampling pulse $SP_9$ shown in FIG. 8(10) becomes high for a second time, samples the voltage $S_{R9}$ of the serial video red signal $S_R$ and then holds the sampled voltage $S_{R9}$ of the serial video red signal $S_R$ while the sampling pulse $SP_9$ becomes low for a second time. The sample holding circuit $13_1$, while the sampling pulse $S_{R1}$ becomes high for a third time, samples the voltage $S_{R1}$ of the serial video red signal $S_R$ and then holds the sampled voltage $S_{R1}$ of the serial video red signal $S_R$ while the sampling pulse $SP_1$ becomes low for a third time. The sample holding circuit $\mathbf{13}_2$, while the sampling pulse $SP_2$ becomes high for a third time, samples the voltage $S_{R2}$ of the serial video red signal $S_R$ and then holds the sampled voltage $S_{R2}$ of the serial video red signal $S_R$ while the sampling pulse $SP_2$ becomes low for a third time.

Then, when the bit values of the $S_{CTL1}$ and the $S_{CTL2}$ of the selector control signal $S_{CTL}$ fed from the controller 31 are changed to be low and the bit value of the $S_{CTL3}$ fed from the controller 31 is changed to be high, the selectors $\mathbf{14}_1$ to $\mathbf{14}_4$, based on the selector control signal $S_{CTL}$, by connecting each of common terminals $T_c$ to a fifth terminal $T_5$, output the voltages $S_{R8}$, $S_{R9}$, $S_{R1}$ and $S_{R2}$ of the serial video red signal $S_R$ held by each of the corresponding sample holding circuits $\mathbf{13}_8$, $\mathbf{13}_9$, $\mathbf{13}_1$, and $\mathbf{13}_2$ as parallel video red signals $S_{RP1}$ to $S_{RP4}$ (refer to a fifth row in FIG. 7).

Next, the sample holding circuit $\mathbf{13}_3$, while the sampling pulse $SP_3$ becomes high for a third time, samples the voltage $S_{R3}$ of the serial video red signal $S_R$ and then holds the sampled voltage $S_{R3}$ of the serial video red signal $S_R$ while the sampling pulse $SP_3$ becomes low for a third time. Similarly, the sample holding circuit $\mathbf{13}_4$, while the sampling pulse $SP_4$ becomes high for a third time, samples the voltage $S_{R4}$ of the serial video red signal $S_R$ and then holds the sampled voltage $S_{R4}$ of the serial video red signal $S_R$ while the sampling pulse $SP_4$ becomes low for a third time. The sample holding circuit $\mathbf{13}_5$, while the sampling pulse $SP_5$ becomes high for a third time, samples the voltage $S_{R5}$ of the serial video red signal $S_R$ and then holds the sampled voltage $S_{R5}$ of the serial video red signal $S_R$ while the sampling pulse $SP_5$ becomes low for a third time. The sample holding circuit $\mathbf{13}_6$, while the sampling pulse $SP_6$ becomes high for a third time, samples the voltage $S_{R6}$ of the serial video red signal $S_R$ and then holds the sampled voltage $S_{R6}$ of the serial video red signal $S_R$ while the sampling pulse $SP_6$ becomes low for a third time.

Then, when the bit values of the $S_{CTL1}$ of the selector control signal $S_{CTL}$ fed from the controller 31 are changed to be high, the selectors $\mathbf{14}_1$ to $\mathbf{14}_4$, based on the selector control signal $S_{CTL}$, by connecting each of common terminals $T_c$ to a sixth terminal $T_6$, output the voltages $S_{R3}$ to $S_{R6}$ of the serial video red signal $S_R$ held by each of the corresponding sample holding circuits $\mathbf{13}_3$ to $\mathbf{13}_6$ as parallel video red signals $S_{RP1}$ to $S_{RP4}$ (refer to a sixth row in FIG. 7).

Next, the sample holding circuit $\mathbf{13}_7$, while the sampling pulse $SP_7$ becomes high for a third time, samples the voltage $S_{R7}$ of the serial video red signal $S_R$ and then holds the sampled voltage $S_{R7}$ of the serial video red signal $S_R$ while the sampling pulse $SP_7$ becomes low for a third time. Similarly, the sample holding circuit $\mathbf{13}_8$, while the sampling pulse $SP_8$ becomes high for a third time, samples the voltage $S_{R8}$ of the serial video red signal $S_R$ and then holds the sampled voltage $S_{R8}$ of the serial video red signal $S_R$ while the sampling pulse $SP_8$ becomes low for a third time. The sample holding circuit $\mathbf{13}_9$, while the sampling pulse $SP_9$ becomes high for a third time, samples the voltage $S_{R9}$ of the serial video red signal $S_R$ and then holds the sampled voltage $S_{R9}$ of the serial video red signal $S_R$ while the sampling pulse $SP_9$ becomes low for a third time. The sample holding circuit $\mathbf{13}_1$, while the sampling pulse $SP_1$ becomes high for a fourth time, samples the voltage $S_{R1}$ of the serial video red signal $S_R$ and then holds the sampled voltage $S_{R1}$ of the serial video red signal $S_R$ while the sampling pulse $SP_1$ becomes low for a fourth time.

Then, when the bit values of the $S_{CTL1}$ of the selector control signal $S_{CTL}$ fed from the controller 31 are changed to be low and the bit value of the $S_{CTL2}$ fed from the controller 31 is changed to be high, the selectors $\mathbf{14}_1$ to $\mathbf{14}_4$, based on the selector control signal $S_{CTL}$, by connecting each of common terminals $T_c$ to a seventh terminal $T_7$, output the voltages $S_{R7}$ to $S_{R9}$ and $S_{R1}$ of the serial video red signal $S_R$ held by each of the corresponding sample holding circuits $\mathbf{13}_7$ to $\mathbf{13}_9$ and $\mathbf{13}_1$ as parallel video red signals $S_{RP1}$ to $S_{RP4}$ (refer to a seventh row in FIG. 7).

Next, the sample holding circuit $\mathbf{13}_2$, while the sampling pulse $SP_2$ becomes high for a fourth time, samples the voltage $S_{R2}$ of the serial video red signal $S_R$ and then holds the sampled voltage $S_{R2}$ of the serial video red signal $S_R$ while the sampling pulse $SP_2$ becomes low for a fourth time. Similarly, the sample holding circuit $\mathbf{13}_3$, while the sampling pulse $SP_3$ becomes high for a fourth time, samples the voltage $S_{R3}$ of the serial video red signal $S_R$ and then holds the sampled voltage $S_{R3}$ of the serial video red signal $S_R$ while the sampling pulse $SP_3$ becomes low for a fourth time. The sample holding circuit $\mathbf{13}_4$, while the sampling pulse $SP_4$ becomes high for a fourth time, samples the voltage $S_{R4}$ of the serial video red signal $S_R$ and then holds the sampled voltage $S_{R4}$ of the serial video red signal $S_R$ while the sampling pulse $SP_4$ becomes low for a fourth time. The sample holding circuit $\mathbf{13}_5$, while the sampling pulse $SP_5$ becomes high for a fourth time, samples the voltage $S_{R5}$ of the serial video red signal $S_R$ and then holds the sampled voltage $S_{R5}$ of the serial video red signal $S_R$ while the sampling pulse $SP_5$ becomes low for a fourth time.

Then, when the bit value of the $S_{CTL1}$ of the selector control signal $S_{CTL}$ fed from the controller 31 is changed to be high, the selectors $\mathbf{14}_1$ to $\mathbf{14}_4$, based on the selector control signal $S_{CTL}$, by connecting each of common terminals $T_c$ to an eighth terminal $T_8$, output the voltages $S_{R2}$ to $S_{R5}$ of the serial video red signal $S_R$ held by each of the corresponding sample holding circuits $\mathbf{13}_2$ to $\mathbf{13}_5$ as parallel video red signals $S_{RP1}$ to $S_{RP4}$ (refer to an eighth row in FIG. 7).

Next, the sample holding circuit $\mathbf{13}_6$, while the sampling pulse $SP_6$ becomes high for a fourth time, samples the voltage $S_{R6}$ of the serial video red signal $S_R$ and then holds the sampled voltage $S_{R6}$ of the serial video red signal $S_R$ while the sampling pulse $SP_6$ becomes low for a fourth time. Similarly, the sample holding circuit $\mathbf{13}_7$, while the sampling pulse $SP_7$ becomes high for a fourth time, samples the voltage $S_{R7}$ of the serial video red signal $S_R$ and then holds the sampled voltage $S_{R7}$ of the serial video red signal $S_R$ while the sampling pulse $SP_7$ becomes low for a fourth time. The sample holding circuit $\mathbf{13}_8$, while the sampling pulse $SP_8$ becomes high for a fourth time, samples the voltage $S_{R8}$ of the serial video red signal $S_R$ and then holds the sampled voltage $S_{R8}$ of the serial video red signal $S_R$ while the sampling pulse $S_{P8}$ becomes low for a fourth time. The sample holding circuit $\mathbf{13}_9$, while the sampling pulse $SP_9$ becomes high for a fourth time, samples the voltage $S_{R9}$ of the serial video red signal $S_R$ and then holds the sampled voltage $S_{R9}$ of the serial video red signal $S_R$ while the sampling pulse $SP_9$ becomes low for a fourth time.

Then, when the bit values of the $S_{CTL1}$ to $S_{CTL3}$ of the selector control signal $S_{CTL}$ fed from the controller 31 are changed to be low and the bit value of the $S_{CTL4}$ fed from the controller 31 is changed to be high, the selectors $\mathbf{14}_1$ to $\mathbf{14}_4$, based on the selector control signal $S_{CTL}$, by connecting each of common terminals $T_c$ to a ninth terminal $T_9$, output the voltages $S_{R6}$ to $S_{R9}$ of the serial video red signal $S_R$ held by each of the corresponding sample holding circuits $\mathbf{13}_6$ to $\mathbf{13}_9$ as parallel video red signals $S_{RP1}$ to $S_{RP4}$ (refer to a ninth row in FIG. 7). Hereinafter, the same processing is sequentially repeated. Operations for the serial video green signal $S_G$ and the serial video blue signal $S_B$ are the same as those for the video red signal $S_R$.

Thus, in the configurations of the embodiment described above, the (2n+1) pieces of the sample holding circuit 13, the number of which is larger by one than the twofold numbers of the phases "n", that is, the number of the sample holding circuit 13 being larger by one than that in a conventional sample holding circuit, are provided and the "n" pieces of the selectors $\mathbf{14}_1$ to $\mathbf{14}_4$, the number of which is the same as the number of the phases "n", used to select one input signal out of (2n+1) pieces of the signals are provided and, moreover, after all voltages of the serial video red signal $S_R$ for every "n" pieces of the signals that should be expanded so as to become "n" phases have been sampled, while all the voltages are being held and during a period excluding a period being equivalent to one half clock of the shift clock SCK being supplied before and after, the selector $\mathbf{14}_1$ to $\mathbf{14}_4$ is switched based on the selector control signal $S_{CTL}$.

Thus, according to the embodiment, the driving circuit can be configured at low costs and being small in size and is able to convert the analog and serial video signal with a high resolution into parallel video signal, which enables high-quality images to be displayed without inconsistencies in displaying.

Therefore, the same effects obtained in the first embodiment can be also achieved in the second embodiment. Moreover, the number of the sample holding circuits can be reduced by one per one color of the video signal from the number of the sample holding circuits required in the first embodiment.

It is apparent that the present invention is not limited to the above embodiments but may be changed and modified without departing from the scope and spirit of the invention. For example, in the above embodiments, after all voltages of the serial video red signal $S_R$ for every "n" pieces of the signals that should be expanded so as to become "n" phases have been sampled, while all the voltages are being held and during the period excluding the period being equivalent to one clock or one half clock of the shift clock being supplied before and after, the selector 4 or 14 is switched based on the selector control signal $S_{CTL}$, however, the present invention is not limited to this operation. The inconsistencies in displaying in the color liquid crystal display are more influenced by delay in switching operations of the selectors than by the delay (mainly in the settling time) in the sample holding circuits, in a sense that the delay in the switching operations of the selectors causes the voltage of the video signal to be displayed in the next period being in the course of sampling to be output as a voltage in the present period from the selector and, as a result, pixels being quite different from the present pixels are displayed. Therefore, to take the delay in switching operations of the selector into consideration, the selector control signal $S_{CTL}$ should be generated so that the selector can be switched for outputting of the voltage of the video signal in the next period. On the other hand, in order to output a voltage of the video signal in the present period, the selector control signal $S_{CTL}$ should be generated so that the selector is switched after the lapse of the settling time of the sample holding circuit. That is, the driving circuit may be so configured that, assuming that the state of the selector is maintained for the time being equivalent to the number of clocks of the shift clock SCK corresponding to the number of the phases "n", the selector is switched earlier at least by the delay time in switching operations of the selector, than the voltage of the video signal in the next period is supplied from the same sample holding circuit and, if necessary, the selector may be switched after the lapse of the settling time of the sample holding circuit to sample the voltage of the video signal occurring last in the present period.

Moreover, in the above embodiments, when the number of the phases to be expanded is set at "n", the number of the sample holding circuits is (2n+1) or (2n+2), however, the present invention is not limited to the above number and the number of the sample holding circuits may be (2n+3) and more.

Also, in the above embodiments, the number of the phases "n" to be expanded is four, however, the number of the phases may be determined by the frequency of the analog and serial video signal supplied from outside, operation speed of the sample holding circuit and mainly the settling time.

In the above embodiments, a gamma converting circuit 33 is mounted at a later stage of serial/parallel converting circuits 1 and 11, however, the gamma converting circuit 33 may be mounted at a front stage of the serial/parallel converting circuits 1 and 11, that is, the driving circuit may be configured that gamma correction is made to the serial video red signal $S_R$. By configuring so, the gamma converting circuit 33 can be constructed more easily.

In the above embodiments, the driving circuit is applied to the color liquid crystal display 21 employing a dot-inverting driving method, however, the driving circuit of the present invention may be applied to the color liquid crystal display 21 employing any one of a data-line driving method, gate line-inverting driving method, and frame-inverting driving method.

In the above embodiments, the data electrode driving circuits $\mathbf{35}_1$ and $\mathbf{35}_2$ are mounted on the upper side and lower side of the color liquid crystal display 21, however, the data electrode driving circuit $\mathbf{35}_1$, $\mathbf{35}_2$ may be mounted on either of the upper or lower side of the color liquid crystal display 21.

In the above embodiments, bit values of the $S_{CTL1}$ to $S_{CTL3}$ or the $S_{CTL1}$ to $S_{CTL4}$ of the selector control signal $S_{CTL}$ and the voltage values of the serial video red signal $S_R$ output from each of selectors $\mathbf{4}_1$ to $\mathbf{4}_4$ or $\mathbf{14}_1$ to $\mathbf{14}_4$ are only examples and the present invention is not limited to these examples accordingly.

In the above embodiments, all the four selectors $\mathbf{4}_1$ to $\mathbf{4}_4$ or $\mathbf{14}_1$ to $\mathbf{14}_4$ are simultaneously switched by the same selector control signal $S_{CTL}$, however, the selectors $\mathbf{4}_1$ to $\mathbf{4}_4$ or $\mathbf{14}_1$ to $\mathbf{14}_4$ may be switched sequentially for every phase with timing of the shift clocks SCK each being different by one clock, as disclosed in Japanese Patent Application Laid-open No. Hei 9-134149. This means that the number of the sample holding circuits may be (n+1) or (n+2). In this case, the method of generating the selector control signal $S_{CTL}$ is made complicated and the timing with which the data electrode driving circuits $\mathbf{35}_1$ and $\mathbf{35}_2$ capture the parallel video red signal $S_{RG}$, video green signal $S_{GG}$, and video blue signal $S_{BG}$ or negative phase video red signal $NS_{RG}$, negative phase video green signal $NS_{GG}$, and negative phase video blue signal $NS_{BG}$ internally must be delayed by one clock of the shift clock SCK for each signal.

In the above embodiments, the prevent invention is applied to the (active-matrix type) color liquid crystal display 21 using a TFT as the switching device, however, it may be applied to a monochromatic liquid crystal display and/or the active-matrix type liquid crystal display using the switching device other than the TFT including a MIM (Metal Insulator Metal) diode, varistor, ringing diode, MOSFET (Metal Oxide Semiconductor Field Effect Transistor), or a like.

Figure 9:
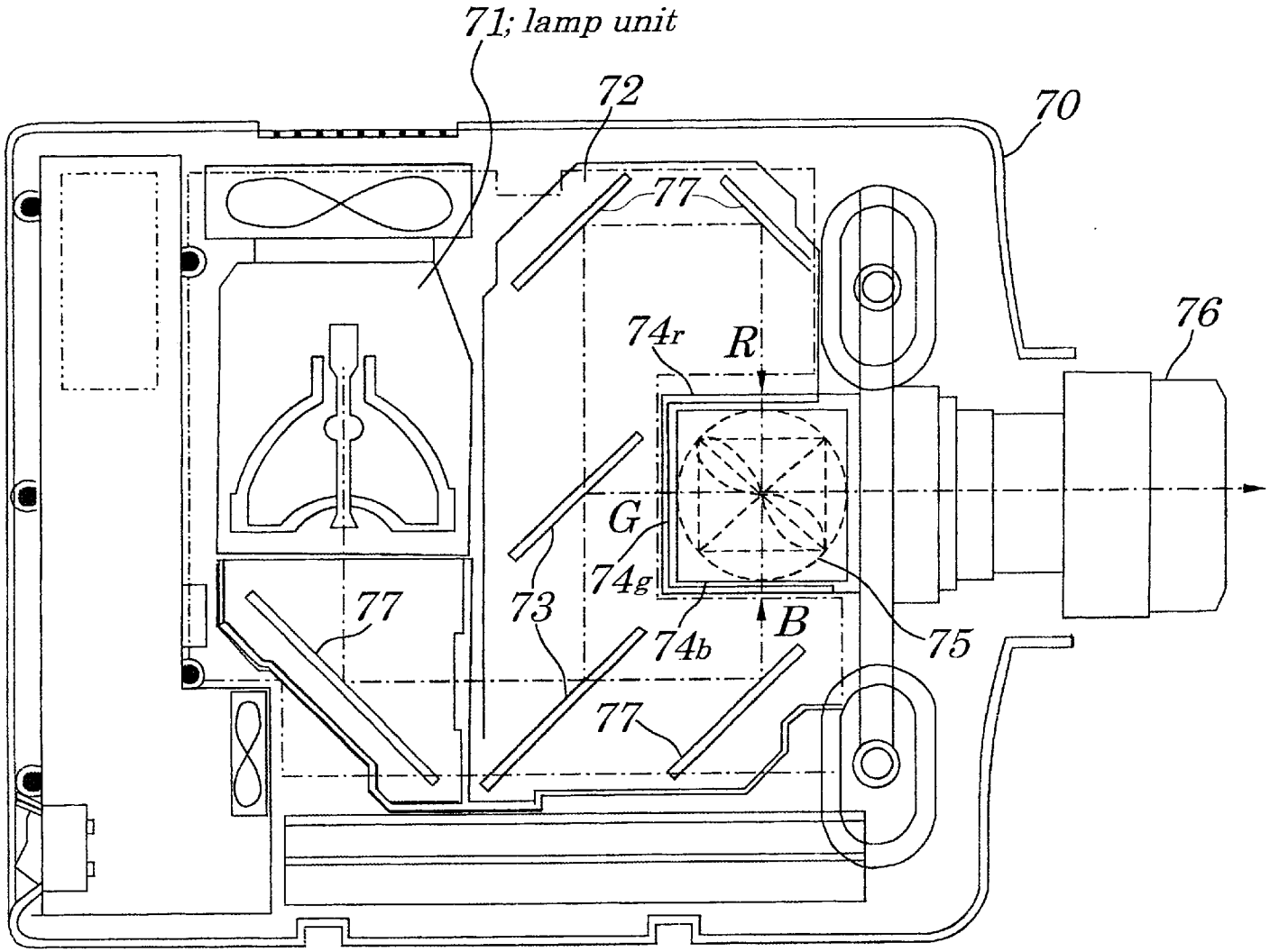
FIG. 9 is a schematic diagram showing a rough configuration of a projector to which the driving circuit of the present invention can be applied.

Moreover, the driving circuit of the liquid crystal display of the present invention is used for an image display device equipped with a direct-viewing type liquid crystal display being used as a monitor of a personal computer and/or for a projector equipped with a projection-type liquid crystal display being used in a home theater or for use in education, or a like. FIG. 9 is a schematic diagram explaining a rough configuration of a projector 70. In the projector 70 shown in FIG. 9, projected light emitted from a lamp unit 71 being a white color light source is divided into light of primary colors R, G, and B (Red, Green, and Blue) by a plurality of mirrors 77 and two dichroic mirrors 73 in the inside of the light guide 72 and is guided toward three liquid crystal displays 74*r*, 74*g*, and 74*b*. Light modulated by the liquid crystal displays 74*r*, 74*g*, and 74*b* is incident from three directions to a dichroic prism 75. Since the light of the red color R and blue color B is bent 90 degrees and the light of the green color G goes straight in the dichroic prism 75, an image having each of the primary colors RGB is synthesized and is projected as color images through the projection lens 76 on a screen. When the driving circuit of the liquid crystal display disclosed in the above embodiments is used as the driving circuit to drive the above liquid crystal display 74*r*, 74*g*, and 74*b*, it can serve as the driving circuit of the liquid crystal display configured at low costs and being small in size, which is capable of converting the analog and serial video signal having a high resolution into the parallel video signal, which thus enables high-quality images to be displayed with high resolutions without inconsistencies in displaying.

It is thus apparent that the present invention is not limited to the above embodiments but may be changed and modified without departing from the scope and spirit of the invention.

What is claimed is:

1. A method for driving a liquid crystal display to drive said liquid crystal display based on n-pieces ("n" is an integer being two or more) of parallel video signals obtained by phase-expanding analog and serial video signals, said method comprising:

a first step of sequentially sample-holding said analog and serial video signals as (n+at least 1) pieces of parallel video signals in response to (n+at least 1) pieces of sampling pulses; and a second step of sequentially outputting n-pieces of continuously sample-held video signals as said n-pieces of parallel video signals while said sample-held video signals are individually held and in response to said sampling pulses each corresponding to each of said sample-held video signals by selecting earlier, at least by a first time required for individually selecting and outputting said sample-held video signals, than sampling is started in a next period.

2. The method for driving the liquid crystal display according to claim 1, wherein in said second step, individual or simultaneous selection of said n-pieces of said continuously sample-held video signals is started after a lapse of a second time being almost equal to a settling time for each sample-held video signal or after a lapse of a second time being almost equal to a settling time of said video signal sample-held last out of said n-pieces of continuously sample-held video signals.

3. The method for driving the liquid crystal display according to claim 2, wherein said first time represents one clock of a plurality of shift clocks used when said sampling pulse is generated and said second time represents one half clock of each of said plural shift clocks.

4. The method for driving the liquid crystal display according to claim 1, wherein said analog and serial video signals include video red signals, video green signals, and video blue signals; and wherein said first and second steps are performed for each of said video red signals, said video green signals, and said video blue signals.

5. The method for driving the liquid crystal display according to claim 1, wherein said liquid crystal display is an active-matrix type liquid crystal display, a switching device of which is any one of a thin film transistor, metal oxide semiconductor field effect transistor, metal insulator metal, varistor, and ringing diode.

6. The method for driving the liquid crystal display according to claim 1, wherein said liquid crystal display is a direct-viewing type liquid crystal display or a projection-type liquid crystal display.

7. A method for driving a liquid crystal display to drive said liquid crystal display based on n-pieces ("n" is an integer being two or more) of parallel video signals obtained by phase-expanding analog and serial video signals, said method comprising:

a first step of sequentially sample-holding said analog and serial video signals as (2n+at least 1) pieces of parallel video signals in response to (2n+at least 1) pieces of sampling pulses; and a second step of simultaneously outputting n-pieces of continuously sample-held video signals as said n-pieces of parallel video signals while said sample-held video signals are commonly held and in response to said sampling pulse corresponding to said video signal sample-held first out of said sample-held video signals by selecting earlier, at least by a first time required for simultaneously selecting and outputting said sample-held video signals, than sampling is started in a next period.

8. The method for driving the liquid crystal display according to claim 7, wherein, in said second step, individual or simultaneous selection of said n-pieces of said continuously sample-held video signals is started after a lapse of a second time being almost equal to a settling time for each sample-held video signal or after a lapse of a second time being almost equal to a settling time of said video signal sample-held last out of said n-pieces of continuously sample-held video signals.

9. The method for driving the liquid crystal display according to claim 8, wherein said first time represents one clock of a plurality of shift clocks used when said sampling pulse is generated and said second time represents one half clock of each of said plural shift clocks.

10. The method for driving the liquid crystal display according to claim 7, wherein said analog and serial video signals include video red signals, video green signals, and video blue signals; and wherein said first and second steps are performed for each of said video red signals, said video green signals, and said video blue signals.

11. The method for driving the liquid crystal display according to claim 7, wherein said liquid crystal display is an active-matrix type liquid crystal display, a switching device of which is any one of a thin film transistor, metal oxide semiconductor field effect transistor, metal insulator metal, varistor, and ringing diode.

12. The method for driving the liquid crystal display according to claim 9, wherein said liquid crystal display is a direct-viewing type liquid crystal display or a projection-type liquid crystal display.

13. A driving circuit for driving a liquid crystal display based on n-pieces ("n" is an integer being two or more) of parallel video signals obtained by phase-expanding analog and serial video signals, comprising:

(n+at least 1) pieces of sample holding circuits to sequentially sample-hold said analog and serial video signals as (n+at least 1) pieces of parallel video signals in response to (n+at least 1) pieces of sampling pulses; and n-pieces of selectors to sequentially output n-pieces of continuously sample-held video signals as said n-pieces of parallel video signals while said sample-held video signals are individually held and in response to said sampling pulses each corresponding to each of said sample-held video signals by selecting earlier, at least by a first time required for individually selecting and outputting said sample-held video signals, than sampling is started in a next period.

14. The driving circuit for driving the liquid crystal display according to claim 13, wherein said n-pieces of selectors start individual or simultaneous selection of said n-pieces of said continuously sample-held video signals after a lapse of a second time being almost equal to a settling time for each sample-held video signal or after a lapse of a second time being almost equal to a settling time of said video signal sample-held last out of said n-pieces of continuously sample-held video signals.

15. The driving circuit for driving the liquid crystal display according to claim 14, wherein said first time represents one clock of plural shift clocks used when said sampling pulse is generated and said second time represents one half clock of said plural shift clocks.

16. The driving circuit for driving the liquid crystal display according to claim 13, wherein said analog and serial video signals include video red signals, video green signals, and video blue signals; and wherein said (n+at least 1) pieces of sample holding circuits and said n-pieces of selectors are mounted for each of said video red signals, video green signals, and video blue signals.

17. The driving circuit for driving the liquid crystal display according to claim 13, wherein said liquid crystal display is an active-matrix type liquid crystal display, a switching device of which is any one of a thin film transistor, metal oxide semiconductor field effect transistor, metal insulator metal, varistor, and ringing diode.

18. The driving circuit for driving the liquid crystal display according to claim 13, wherein said liquid crystal display is a direct-viewing type liquid crystal display or a projection-type liquid crystal display.

19. A driving circuit for driving said liquid crystal display based on n-pieces ("n" is an integer being two or more) of parallel video signals obtained by phase-expanding analog and serial video signals, comprising:

(2n+at least 1) pieces of sample holding circuits to sequentially sample-hold said analog and serial video signals as (2n+at least 1) pieces of parallel video signals in response to (2n+at least 1) pieces of sampling pulses; and n-pieces of selectors to simultaneously output n-pieces of continuously sample-held video signals as said n-pieces of parallel video signals while said sample-held video signals are commonly held and in response to said sampling pulse corresponding to said video signal sample-held first out of said sample-held video signals by selecting earlier, at least by a first time required for simultaneously selecting and outputting said sample-held video signals, than sampling is started in a next period.

20. The driving circuit for driving the liquid crystal display according to claim 19, wherein said n-pieces of selectors start individual or simultaneous selection of said n-pieces of said continuously sample-held video signals after a lapse of a second time being almost equal to a settling time for each sample-held video signal or after a lapse of a second time being almost equal to a settling time of said video signal sample-held last out of said n-pieces of continuously sample-held video signals.

21. The driving circuit for driving the liquid crystal display according to claim 20, wherein said first time represents one clock of plural shift clocks used when said sampling pulse is generated and said second time represents one half clock of said plural shift clocks.

22. The driving circuit for driving the liquid crystal display according to claim 19, wherein said analog and serial video signals include video red signals, video green signals, and video blue signals; and wherein said (2n+at least 1) pieces of sample holding circuits and said n-pieces of selectors are mounted for each of said video red signals, video green signals, and video blue signals.

23. The driving circuit for driving the liquid crystal display according to claim 19, wherein said liquid crystal display is an active-matrix type liquid crystal display, a switching device of which is any one of a thin film transistor, metal oxide semiconductor field effect transistor, metal insulator metal, varistor, and ringing diode.

24. The driving circuit for driving the liquid crystal display according to claim 19, wherein said liquid crystal display is a direct-viewing type liquid crystal display or a projection-type liquid crystal display.

25. An image display device comprising:

a direct-viewing type or projection-type liquid crystal display; and a driving circuit for driving said liquid crystal display based on n-pieces ("n" is an integer being two or more) of parallel video signals obtained by phase-expanding analog and serial video signals, including:

(n+at least 1) pieces of sample holding circuits to sequentially sample-hold said analog and serial video signals as (n+at least 1) pieces of parallel video signals in response to (n+at least 1) pieces of sampling pulses; and n-pieces of selectors to sequentially output n-pieces of continuously sample-held video signals as said n-pieces of parallel video signals while said sample-held video signals are individually held and in response to said sampling pulses each corresponding to each of said sample-held video signals by selecting earlier, at least by a first time required for individually selecting and outputting said sample-held video signals, than sampling is started in a next period.

26. The image display device according to claim 23, wherein said liquid crystal display is an active-matrix type liquid crystal display, a switching device of which is any one of a thin film transistor, metal oxide semiconductor field effect transistor, metal insulator metal, varistor, and ringing diode.

27. An image display device comprising:

a direct-viewing type or projection-type liquid crystal display; and a driving circuit for driving said liquid crystal display based on n-pieces ("n" is an integer being two or more) of parallel video signals obtained by phase-expanding analog and serial video signals, including:

(2n+at least 1) pieces of sample holding circuits to sequentially sample-hold said analog and serial video signals as (2n+at least 1) pieces of parallel video signals in response to (2n+at least 1) pieces of sampling pulses; and n-pieces of selectors to simultaneously output n-pieces of continuously sample-held video signals as said n-pieces of parallel video signals while said sample-held video signals are commonly held and in response to said sampling pulse corresponding to said video signal sample-held first out of said sample-held video signals by selecting earlier, at least by a first time required for simultaneously selecting and outputting said sample-held video signals, than sampling is started in a next period.

28. The image display device according to claim 27, wherein said liquid crystal display is an active-matrix type liquid crystal display, a switching device of which is any one of a thin film transistor, metal oxide semiconductor field effect transistor, metal insulator metal, varistor, and ringing diode.

* * * * *